US009353603B2

(12) United States Patent
Mouton et al.

(10) Patent No.: US 9,353,603 B2
(45) **Date of Patent: *May 31, 2016**

(54) LANDING STRING COMPENSATOR

(71) Applicant: Weatherford Technology Holdings, LLC, Houston, TX (US)

(72) Inventors: David E. Mouton, Missouri City, TX (US); Michael Hayes, Houston, TX (US); Karsten Heidecke, Houston, TX (US); David J. Havens, Houston, TX (US); Raleigh Fisher, Houston, TX (US); Jim Hollingsworth, Missouri City, TX (US); Doyle F. Boutwell, Jr., Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/286,655

(22) Filed: May 23, 2014

(65) Prior Publication Data

US 2014/0338917 A1 Nov. 20, 2014

Related U.S. Application Data

(63) Continuation of application No. 12/422,199, filed on Apr. 10, 2009, now Pat. No. 8,733,447.

(60) Provisional application No. 61/043,900, filed on Apr. 10, 2008, provisional application No. 61/048,121, filed on Apr. 25, 2008, provisional application No. 61/206,856, filed on Feb. 5, 2009.

(51) Int. Cl.
*E21B 17/01* (2006.01)
*E21B 41/00* (2006.01)

(Continued)

(52) U.S. Cl.
CPC ..... *E21B 41/0014* (2013.01); *E21B 17/07* (2013.01); *E21B 19/09* (2013.01)

(58) Field of Classification Search
CPC ..... E21B 17/01; E21B 17/07; E21B 19/006; E21B 19/09
USPC ..... 166/355, 339, 352, 367; 405/224.2–224.4; 285/298, 302
See application file for complete search history.

(56) References Cited

U.S. PATENT DOCUMENTS 3,313,345 A 4/1967 Fischer
3,601,187 A 8/1971 Tidwell (Continued)

FOREIGN PATENT DOCUMENTS

GB 2316108 A 2/1998
GB 2358032 A 7/2001

(Continued)

OTHER PUBLICATIONS

EPO Office Action dated Nov. 20, 2015, for EPO Application No. 11195442.6.

*Primary Examiner* — Matthew R Buck
(74) *Attorney, Agent, or Firm* — Patterson + Sheridan LLP

(57) ABSTRACT

Apparatus and methods for compensating a landing string due to movement of a floating rig platform are provided. In one aspect, a compensation system for use with a landing string is provided. The compensation system includes a slip joint member attachable to the landing string, the slip joint member having an upper portion and a lower portion. The compensation system further includes a first lock assembly configured to connect the upper portion of the slip joint member to a floating rig. Additionally, the compensation system includes a second lock assembly configured to connect the lower portion of the slip joint member to a riser disposed below the floating rig. In another aspect, a method for compensating a landing string due to movement of a floating rig is provided.

7 Claims, 24 Drawing Sheets

(51) Int. Cl.
*E21B 17/07* (2006.01)
*E21B 19/09* (2006.01)

(56) References Cited

U.S. PATENT DOCUMENTS

| | | | | | |
|---|---|---|---|---|---|
| 3,647,245 | A | | 3/1972 | Hanes et al. | |
| 3,741,305 | A | * | 6/1973 | Young et al. | 166/336 |
| 3,785,445 | A | * | 1/1974 | Scozzafava | 175/5 |
| 3,791,442 | A | * | 2/1974 | Watkins | 166/352 |
| 3,917,006 | A | * | 11/1975 | Kellner | 175/5 |
| 3,955,621 | A | * | 5/1976 | Webb | 166/355 |
| 3,998,280 | A | * | 12/1976 | Kisling, III | 175/5 |
| 3,999,617 | A | * | 12/1976 | Ilfrey et al. | 175/7 |
| 4,049,239 | A | * | 9/1977 | Howell | 166/355 |
| 4,059,148 | A | * | 11/1977 | Blomsma | 166/359 |
| 4,176,722 | A | * | 12/1979 | Wetmore et al. | 175/7 |
| 4,367,981 | A | * | 1/1983 | Shapiro | 405/224.2 |
| 4,428,433 | A | | 1/1984 | Watkins | |
| 4,466,487 | A | | 8/1984 | Taylor, Jr. | |
| 4,524,832 | A | * | 6/1985 | Roche et al. | 166/347 |
| 4,597,447 | A | * | 7/1986 | Roche et al. | 166/347 |
| 4,615,542 | A | * | 10/1986 | Ideno et al. | 285/11 |
| 4,626,135 | A | * | 12/1986 | Roche | 405/224.2 |
| 4,668,126 | A | * | 5/1987 | Burton | 405/169 |
| 4,712,620 | A | * | 12/1987 | Lim et al. | 166/355 |
| 4,883,387 | A | * | 11/1989 | Myers et al. | 405/224.4 |
| 5,069,488 | A | * | 12/1991 | Freyer et al. | 285/302 |
| 5,846,028 | A | * | 12/1998 | Thory | 405/195.1 |
| 6,148,922 | A | * | 11/2000 | Vatne | 166/367 |
| 6,173,781 | B1 | * | 1/2001 | Milne et al. | 166/355 |
| 6,273,193 | B1 | * | 8/2001 | Hermann et al. | 166/359 |
| 6,470,975 | B1 | * | 10/2002 | Bourgoyne et al. | 175/57 |
| 6,516,887 | B2 | * | 2/2003 | Nguyen et al. | 166/348 |
| 6,739,395 | B2 | * | 5/2004 | Reynolds | 166/346 |
| 7,063,159 | B2 | * | 6/2006 | Patton et al. | 166/355 |
| 7,114,573 | B2 | * | 10/2006 | Hirth et al. | 166/382 |
| 7,131,922 | B2 | * | 11/2006 | Williams et al. | 474/101 |
| 7,188,677 | B2 | * | 3/2007 | Moe | 166/355 |
| 7,219,739 | B2 | * | 5/2007 | Robichaux | 166/355 |
| 7,314,087 | B2 | * | 1/2008 | Robichaux | 166/355 |
| 7,334,967 | B2 | * | 2/2008 | Blakseth et al. | 405/224.2 |
| 7,337,849 | B2 | * | 3/2008 | Williams | 166/355 |
| 7,377,323 | B2 | * | 5/2008 | Walker et al. | 166/348 |
| 7,438,505 | B2 | * | 10/2008 | Olsen et al. | 405/224.4 |
| 7,699,109 | B2 | * | 4/2010 | May et al. | 166/367 |
| 7,866,399 | B2 | * | 1/2011 | Kozicz et al. | 166/367 |
| 8,733,447 | B2 | * | 5/2014 | Mouton et al. | 166/355 |
| 2006/0219411 | A1 | | 10/2006 | Moksvold | |
| 2008/0302530 | A1 | * | 12/2008 | Shampine et al. | 166/250.08 |

FOREIGN PATENT DOCUMENTS

| | | | | | |
|---|---|---|---|---|---|
| WO | 9743516 | A1 | | 11/1997 | |
| WO | 0024998 | A1 | | 5/2000 | |
| WO | WO 2008003974 | A2 | * | 1/2008 | E21B 19/00 |

* cited by examiner

LANDING STRING COMPENSATOR

CROSS-REFERENCE TO RELATED APPLICATIONS

This application is a continuation of co-pending U.S. patent application Ser. No. 12/422,199 filed Apr. 10, 2009, which claims benefit of U.S. provisional patent application Ser. No. 61/043,900, filed Apr. 10, 2008, U.S. provisional patent application Ser. No. 61/048,121, filed Apr. 25, 2008 and U.S. provisional patent application Ser. No. 61/206,856, filed Feb. 5, 2009, which are herein incorporated by reference.

BACKGROUND OF THE INVENTION

1. Field of the Invention

Embodiments of the present invention generally relates to an apparatus and method for compensating a landing string below a rig floor due to movement of a floating rig platform.

2. Description of the Related Art

As oil and gas production is taking place in progressively deeper water, floating rig platforms are becoming a required piece of equipment. Floating rig platforms are typically connected to a wellhead on the ocean floor by a near vertical tubular called a drilling riser. The drilling riser is typically heave compensated due to the movement of the floating rig platform relative to the wellhead by using equipment on the floating rig platform. Running a completion assembly or string of tubulars through the drilling riser and suspending it in the well is facilitated by using a landing string. Subsequent operations through the landing string may require high pressure surface operations such as well testing, wireline or coil tubing work.

The landing string is also heave compensated due to the movement of the floating rig platform (caused by ocean currents and waves) relative to the wellhead on the ocean floor. Landing string compensation is typically done by a crown mounted compensator (CMC) or active heave compensating drawworks (AHD). If any high pressure operations will be done through the landing string, then the high pressure equipment also needs to be rigged up to safely contain these pressures. Since the landing string is moving relative to the rig floor, the compensation is provided through the hook/block, devices such as long bails or coil tubing lift frames are required to enable tension to be transferred to the landing string and provide a working area for the pressure containment equipment. Rigging up these devices take time and the pressure containment equipment must be rigged up at heights above the rig floor while the entire landing string assembly is moving due to the compensation. Therefore, there is a need for an apparatus and method for providing landing string compensation below the rig floor which allows for faster and safer rig up of pressure containment equipment above the rig floor.

SUMMARY OF THE INVENTION

The present invention generally relates to an apparatus and method for compensating a landing string due to movement of a floating rig platform. In one aspect, a compensation system for use with a landing string is provided. The compensation system includes a slip joint member attachable to the landing string, the slip joint member having an upper portion and a lower portion. The compensation system further includes a first lock assembly configured to connect the upper portion of the slip joint member to a floating rig. Additionally, the compensation system includes a second lock assembly configured to connect the lower portion of the slip joint member to a riser disposed below the floating rig.

In another aspect, a method for compensating a landing string due to movement of a floating rig is provided. The method comprising the step of connecting a compensation system to the landing string, the compensation system having a first lock, a second lock and a slip joint. The method further comprising the step of placing the compensation system and the landing string in a riser. Further, the method comprising the step of securing a lower portion of the slip joint to the riser by activating the second lock. The method also comprising the step of securing an upper portion of the slip joint to the floating rig by activating the first lock. Additionally, the method comprising the step of allowing the slip joint to extend or retract as the floating rig moves relative to the riser.

In further aspect, a method for compensating a landing string due to movement of a floating rig is provided. The method comprising the step attaching a portion of the landing string to a riser string, wherein the landing string is compensated by a landing string compensator and the riser string is compensated by a riser string compensator. The method further comprising the step of releasing the landing string from the landing string compensator. Additionally, the method comprising the step of compensating the landing string using the riser string compensator.

In yet a further aspect, a compensation system for use with a landing string is provided. The compensation system comprising a slip joint member attachable to the landing string. The slip joint member having an upper portion connectable to a floating rig and a lower portion connectable to a riser disposed below the floating rig, wherein the slip joint member is configured to move between an extended and a retracted position as the floating rig moves relative to the riser.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to an apparatus and method for compensating a landing string due to movement of a floating rig platform. To better understand the aspects of the present invention and the methods of use thereof, reference is hereafter made to the accompanying drawings.

Figure 1:
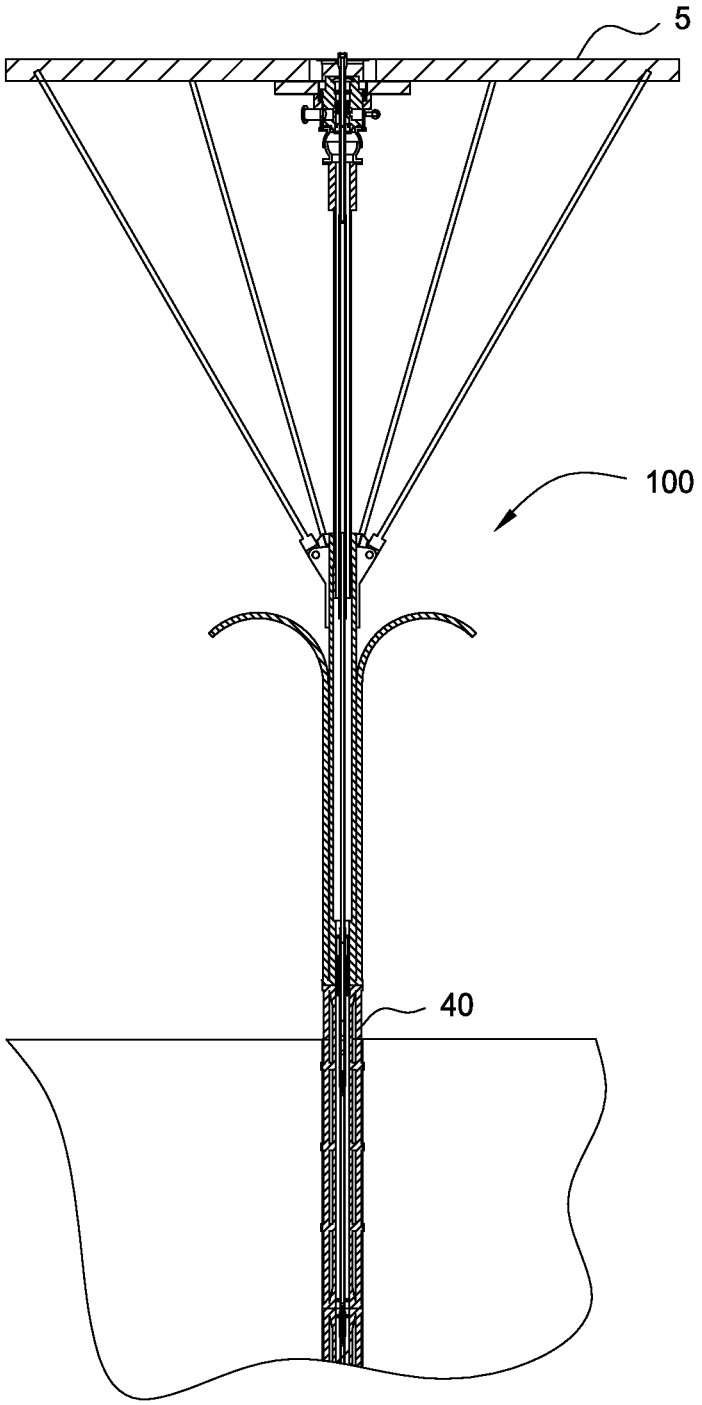
FIG. 1 is a view illustrating a landing string compensator system disposed in a riser.

FIG. 1 is a view illustrating a landing string compensator system 100 disposed in a riser 40. The riser 40 connects a floating rig 5 to a wellhead (not shown) disposed on a seafloor. Generally, the compensator system 100 is configured to compensate for the movement of the floating rig 5 relative to the wellhead disposed on the seafloor. The compensator system 100 will be described generally in relation to FIGS. 1-3. Thereafter, the rig up tool sequence of the compensator system 100 and the operation of the compensator system 100 will be described in FIGS. 4-13.

Figure 2:
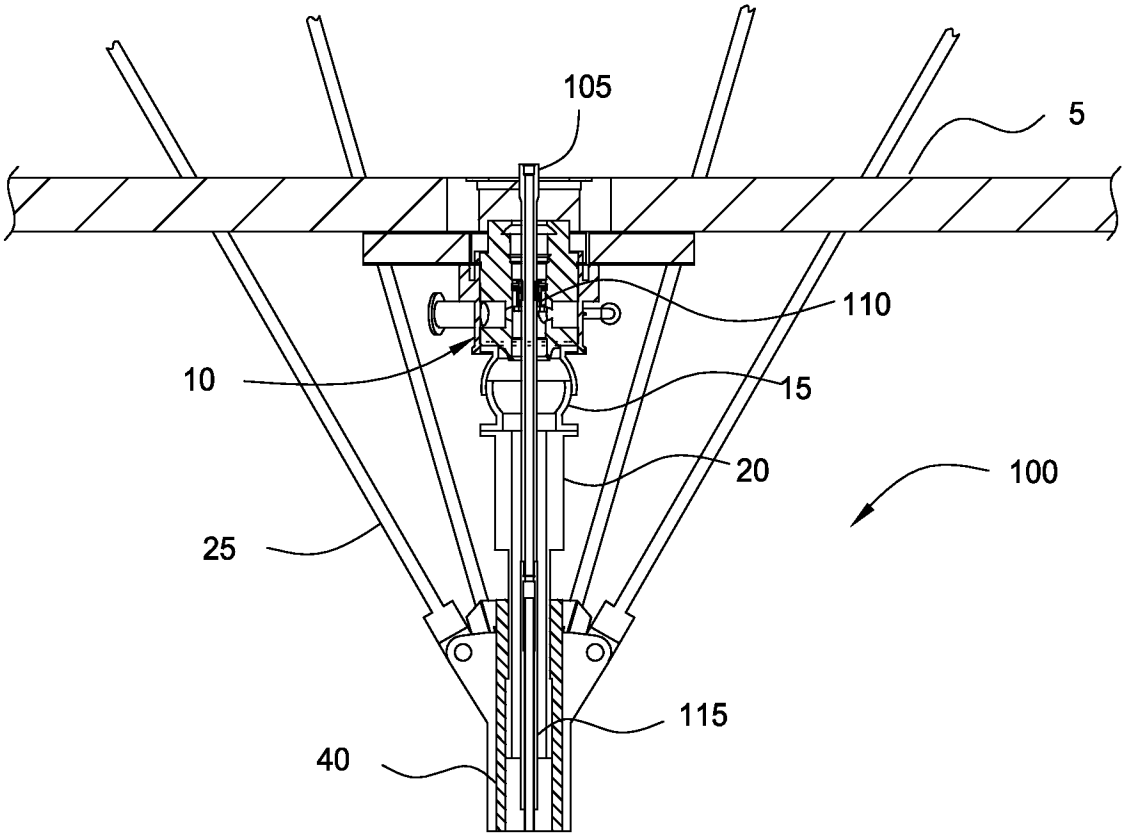
FIG. 2 is a view illustrating an upper portion of the compensator system.

FIG. 2 is a view illustrating an upper portion of the compensator system 100. As shown in FIG. 2, the compensator system 100 includes a diverter lock 110 that is configured to engage a profile in a diverter housing 10. The diverter lock 110 is connected to a high pressure slip joint 115 via a mandrel 105. Generally, the diverter lock 110 secures the upper portion of the compensator system 100 to the floating rig 5 via the diverter housing 10. As also shown in FIG. 2, a flex joint 15 and a telescopic joint 20 are connected between the diverter housing 10 and the riser 40. The flex joint 15 and the telescopic joint 20 are used in conjunction with tensioner cables 25 to compensate for the movement of the floating rig 5 that is connected to the wellhead disposed on the seafloor via the riser 40. The tensioner cables 25 are part of a riser compensator arrangement (not shown). Generally, the riser compensator arrangement is connected to the riser 40 in order to compensate for the movement of the floating rig 5 relative to the wellhead. The riser compensator arrangement may include cylinders that are attached to the tensioner cables 25. The cylinders extend and retract as the floating rig 5 moves, thereby allowing the riser 40 to remain substantially stationary relative to the wellhead. It is important to note that using the compensator system 100 to lock and hang the landing string 50 off of the riser 40, as set forth herein, permits the utilization of the large capacity riser compensator arrangement. This allows the compensator system 100 to be compact and allows the compensator system 100 to fit inside the riser 40, thereby achieving a below the rig floor landing string compensation system.

Figure 3:
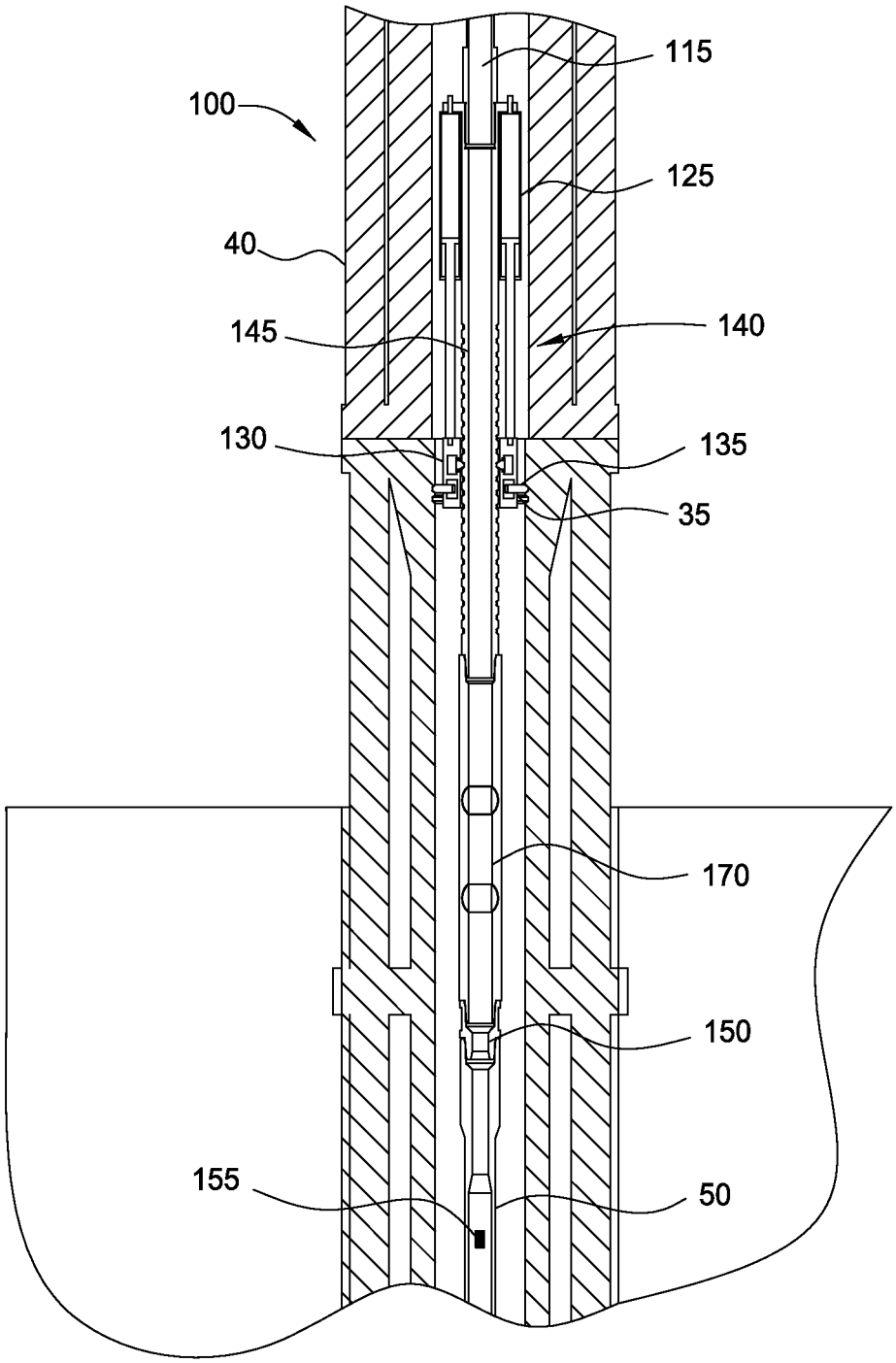
FIG. 3 is a view illustrating a lower portion of the compensator system.

FIG. 3 is a view illustrating a lower portion of the compensator system 100. As shown, the compensator system 100 includes a locking assembly 140. The locking assembly 140 comprises a locking mandrel 145, cylinders 125, dogs 135 and tabs 130. The locking assembly 140 connects the lower portion of the compensator system 100 to the riser 40. Thus, the compensator system 100 is connected to the floating rig 5 via the diverter lock 110 (see FIG. 2) and to the riser 40 via the locking assembly 140. With the upper and lower portions of the compensator system 100 connected to the respective parts, the slip joint 115 in the compensator system 100 allows the compensator system 100 to compensate for the movement of the floating rig 5. Generally, the slip joint 115 is configured to accommodate tubing movement while maintaining a hydraulic seal between the upper and lower portions of the compensator system 100. In other words, the slip joint 115 is a telescoping joint disposed inline between the upper and lower portions of the compensator system 100 that permits the upper portion to move with the floating rig 5 while allowing the lower portion to be fixed relative to the wellhead at the seafloor. As the floating rig 5 moves relative to the seafloor, the slip joint 115 telescopes in or out by substantially the same amount so that the lower portion of the compensator system 100 below the slip joint 115 is relatively unaffected by the floating rig 5 motion.

The dogs 135 of the locking assembly 140 are configured to engage profiles 35 in the riser 40. Upon activation of the cylinders 125, the dogs 135 move along the locking mandrel 145 as inner tabs 130 of the locking assembly 140 engage profiles on the locking mandrel 145. As will be described herein, the cylinders 125 position the dogs 135 adjacent the profiles 35 on the riser 40. In one embodiment, the compensator system 100 includes a sensor arrangement 155. The sensor arrangement 155 may be configured to sense the load (i.e. tension) on the landing string 50 and/or a pressure in the landing string 50. The data from the sensor arrangement 155 may be used to facilitate the placement of the landing string 50 in the riser 40 and to monitor the pressure in the landing string 50. The data may also be used in the operation of a lubricator valve 170.

The compensator system 100 also includes the lubricator valve 170. As shown in FIG. 3, the lubricator valve 170 is attached to a lower end of the locking mandrel 145 of the locking assembly 140. However, it should be noted that the lubricator valve 170 may be positioned at any location within the compensator system 100 without departing from the principles of the present invention. Generally, the lubricator valve 170 is used to close off (or shut off) the pressure in the compensator system 100. In one embodiment, the lubricator valve 170 includes two ball valves that are configured to close the lubricator valve 170.

Figure 4A:
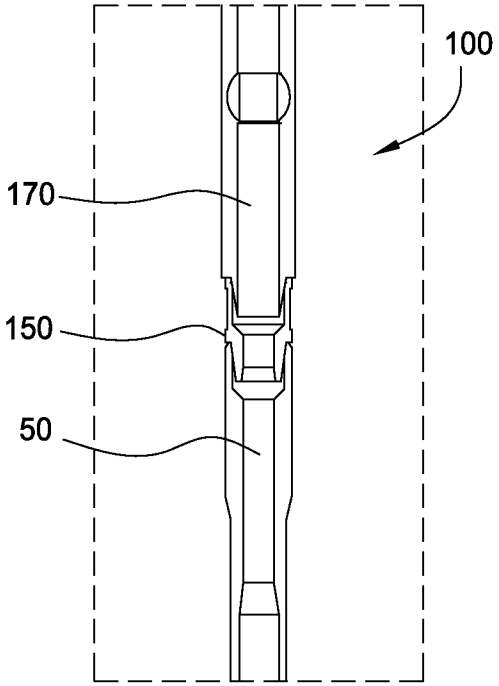
FIGS. 4 and 4A are views illustrating the compensator system attached to a landing string.
Figure 4:
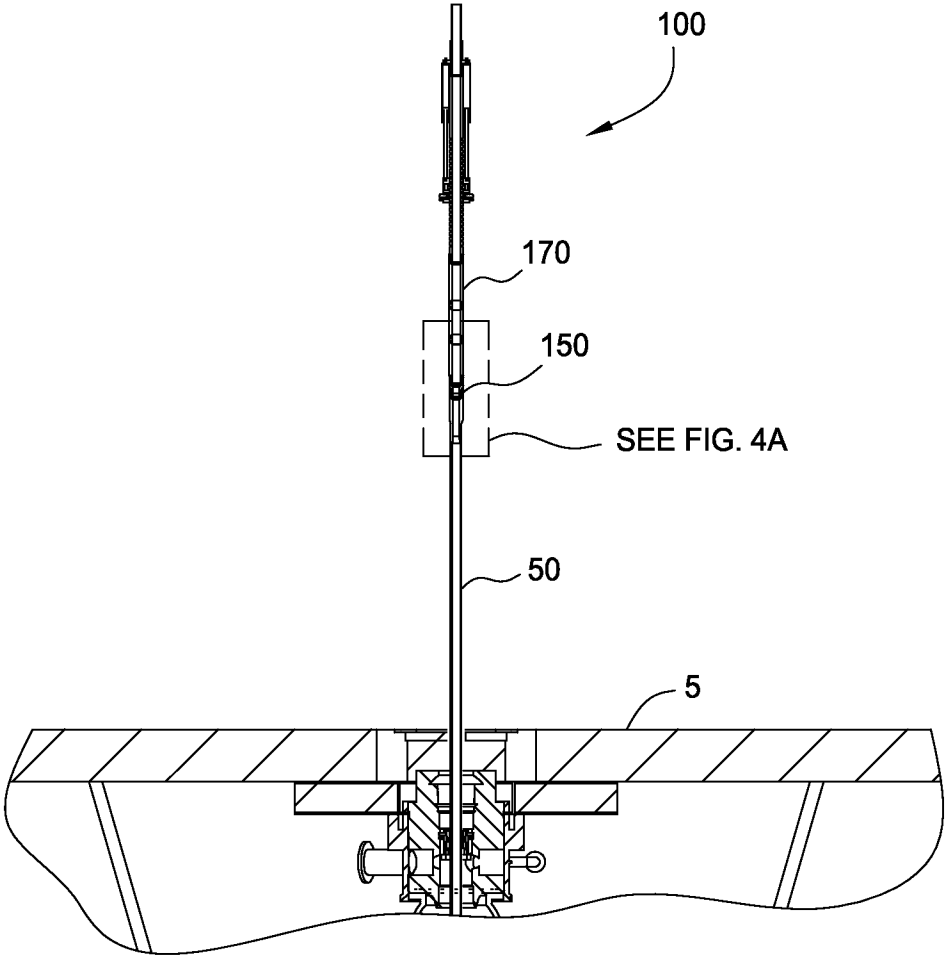

FIGS. 4 and 4A are views illustrating the compensator system 100 attached to a landing string 50. The rig up tool sequence generally begins by attaching the compensator system 100 to the landing string 50 via a crossover sub 150. Generally, the crossover sub 150 is a connection member having an upper end and a lower end. The upper end of the crossover sub 150 is configured to attach to the compensator system 100 and a lower end of the crossover sub 150 is configured to attach to the landing string 50. In the arrangement shown in the FIG. 4, the crossover sub 150 is attached directly to the lubricator valve 170.

Figure 5:
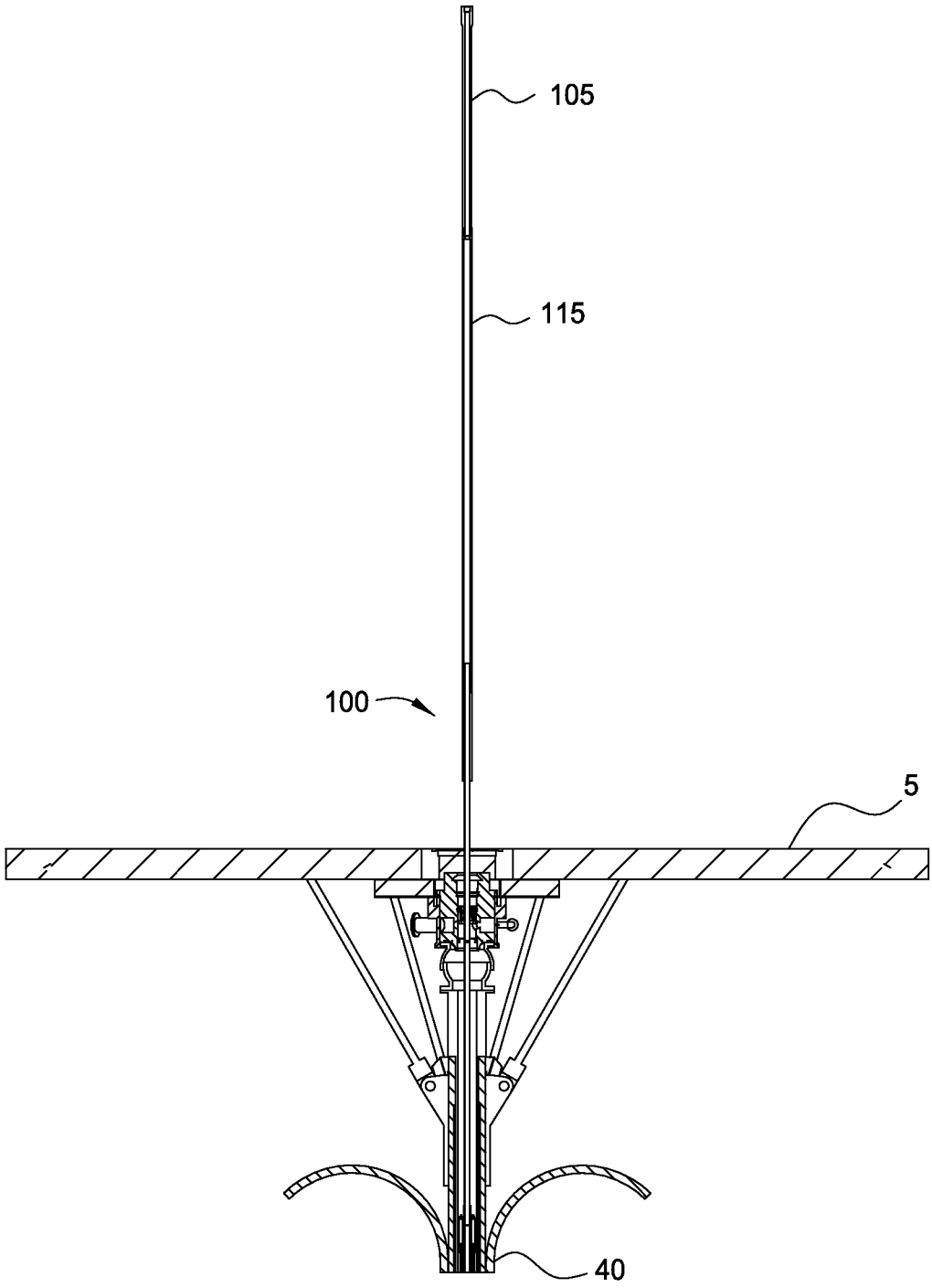
FIG. 5 is a view illustrating a portion of the compensator system being positioned in the riser.

FIG. 5 is a view illustrating a portion of the compensator system 100 being positioned in the riser 40. After the compensator system 100 is attached to the landing string 50, the slip joint 115 is stroked out and may be locked in the stroked out position to facilitate the placement of the compensator system 100 and the landing string 50 within the riser 40.

Figure 6A:
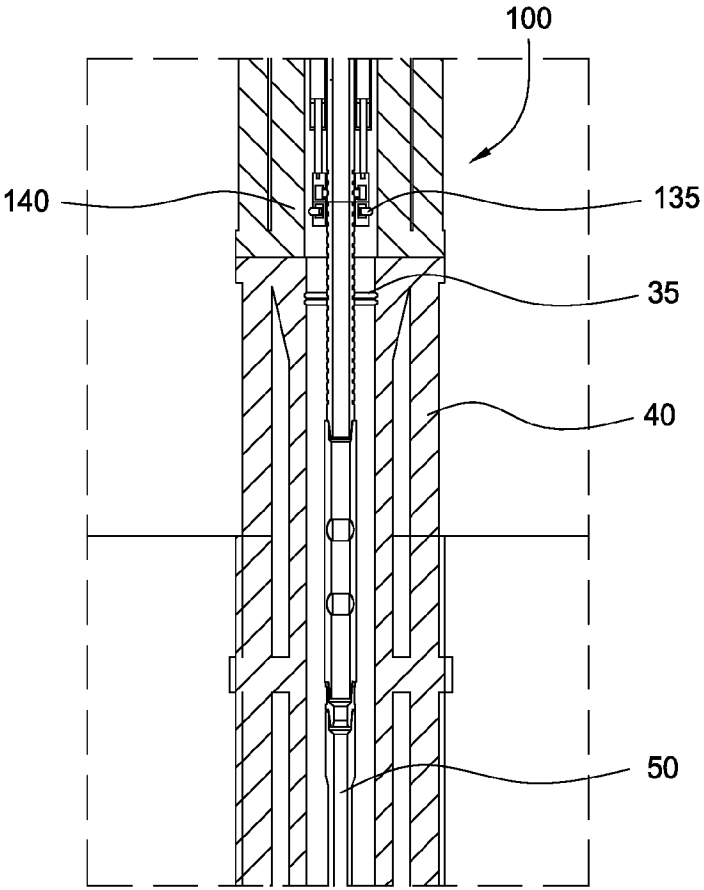
FIGS. 6 and 6A are views illustrating the compensator system after landing the landing string.
Figure 6:
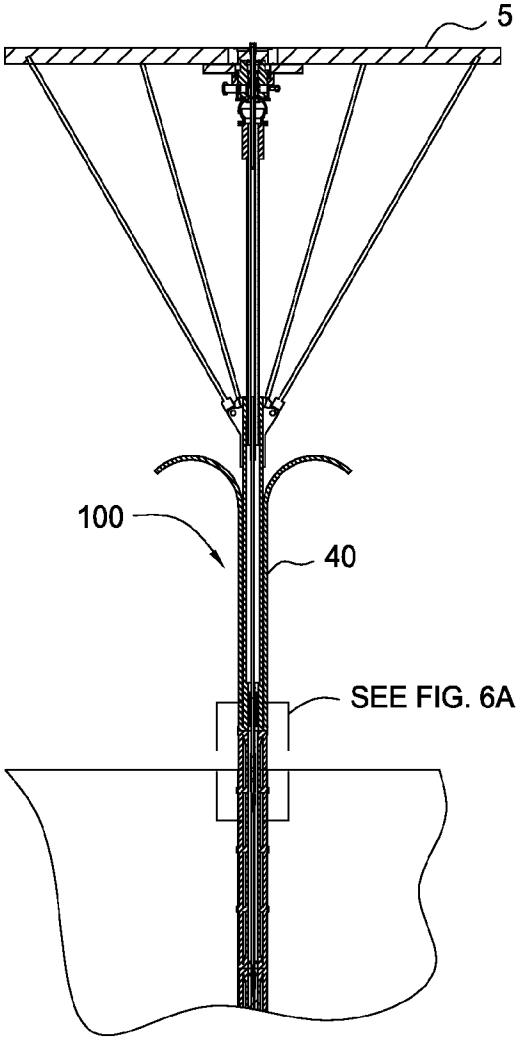

FIGS. 6 and 6A are views illustrating the compensator system 100 after landing a tubing hanger (not shown) in the wellhead. After the slip joint 115 has been stroked out, the compensator system 100 is further lowered in the riser 40 until the tubing hanger on the landing string 50 is landed in the wellhead. It should be noted that the compensator system 100 acts as a rigid single unit to facilitate the placement of the tubing hanger in the wellhead. As shown in FIG. 6A, the compensator system 100 is located in the riser 40 such that the dogs 135 in the locking assembly 140 are positioned proximate the profiles 35.

Figure 9:
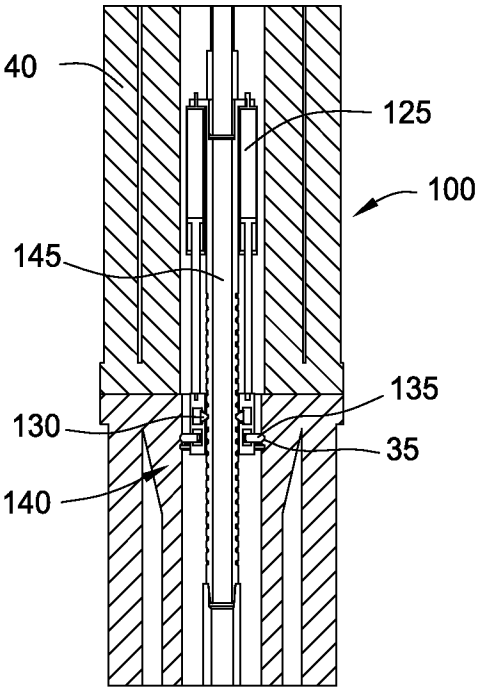
FIGS. 7-9 are views illustrating the lower portion of the compensator system engaged in the riser.
Figure 8:
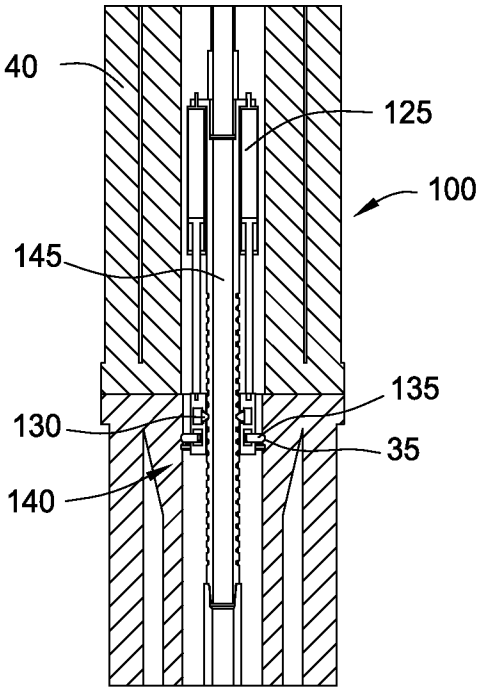
Figure 7:
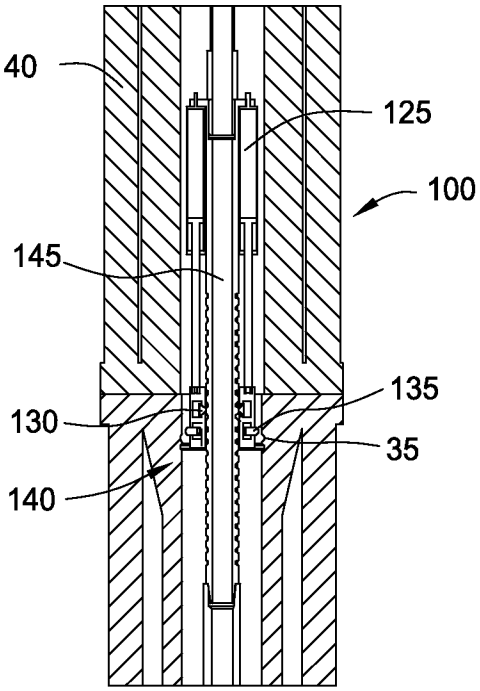

FIGS. 7-9 are views illustrating a lower portion of the compensator system 100 engaged in the riser 40. After a portion of the compensator system 100 is positioned within the riser 40, the locking assembly 140 is activated. Hydraulic pressure is communicated to the cylinders 125, thereby causing the cylinders 125 to urge the dogs 135 along the locking mandrel 145 as the inner tabs 130 engage profiles on the locking mandrel 145, as shown in FIG. 7. The dogs 135 continue to move along the locking mandrel 145 until the dogs 135 engage the profiles 35 in the riser 40, as shown in FIG. 8. Applied pressure actuates both the tabs 130 and the dogs 135 via an internal bore of the rod in the cylinders 125. Once the dogs 135 locate the profiles 35 in the riser 40, pressure will immediately increase, as the locking assembly 140 will not allow additional volume into the system. The increase of pressure is used as an indicator that the dogs 135 are engaged in the profiles 35. At this time, the cylinders 125 are locked in the position illustrated in FIG. 9. Further, the dogs 135 are locked in the profiles 35 and the inner tabs 130 are locked in profiles on the locking mandrel 145. In one embodiment, the dogs 135 are spring loaded such that the dogs 135 lock in the profiles 35. After the dogs 135 are locked, the pressure in the cylinders 125 may be maintained or the pressure may be increased (i.e. charged) which causes the landing string 50 below the locking assembly 140 to be in tension. The tension in the landing string 50 may be useful during a well testing operation which causes the landing string 50 to heat up and expand because the tension accommodates the axial expansion of the landing string 50 due to the heat. The pressure in the cylinders 125 may also be changed in order to adjust the tension in the landing string 80.

After the compensator system 100 is fixed to the riser 40, the riser 40 supports a substantial portion of the landing string 50 and the compensator system 100. Due to the additional weight, the nitrogen pressure of the cylinders (not shown) connected to the tensioner cables 25 is increased in order to support the additional weight. In other words, after the compensator system 100 connects the landing string 50 to the riser 40, the compensator arrangement (i.e. crown mounted compensator) originally attached to the landing string 50 is de-energized to allow the landing string 50 to be compensated by the riser compensator arrangement. This configuration allows the landing string 50 and the riser 40 to be compensated by a single compensator arrangement (i.e. the riser compensator arrangement).

In another embodiment, a packer (not shown) may be used in place of the locking assembly 140. In this embodiment, the packer is activated after the compensator system 100 is positioned within the riser 40. Typically, pressurized fluid is used to activate the packer. Upon activation of the packer, the lower portion of the compensator system 100 is fixed to the riser 40. In another embodiment, a slip arrangement may be used in place of the locking assembly 140. In this embodiment, the slip arrangement is activated after the compensator system 100 is positioned within the riser 40. Upon activation of the slip arrangement, the lower portion of the compensator system 100 is fixed to the riser 40

Figure 10:
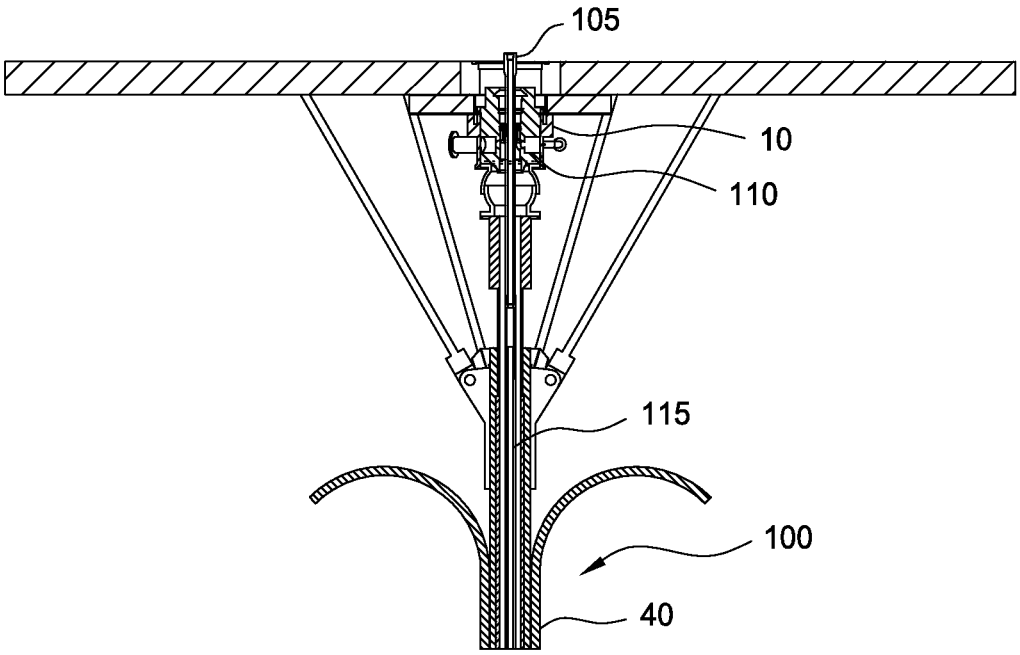
FIG. 10 is a view illustrating the upper portion of the compensator system after the compensator system is released from a support structure.

FIG. 10 is a view illustrating the upper portion of the compensator system 100 after the compensator system 100 is released from a support structure (not shown). After the lower portion of the compensator system 100 is fixed to the riser 40, the mandrel 105 is released from the support structure. In one embodiment, a hook (not shown) is removed from the compensator system 100. Further, the lock on the slip joint 115 may be released to allow the slip joint 115 to move from the stroked out position. The release of the mandrel 105 and the slip joint 115 facilitates the positioning of the diverter lock 110 within the diverter housing 10.

Figure 11:
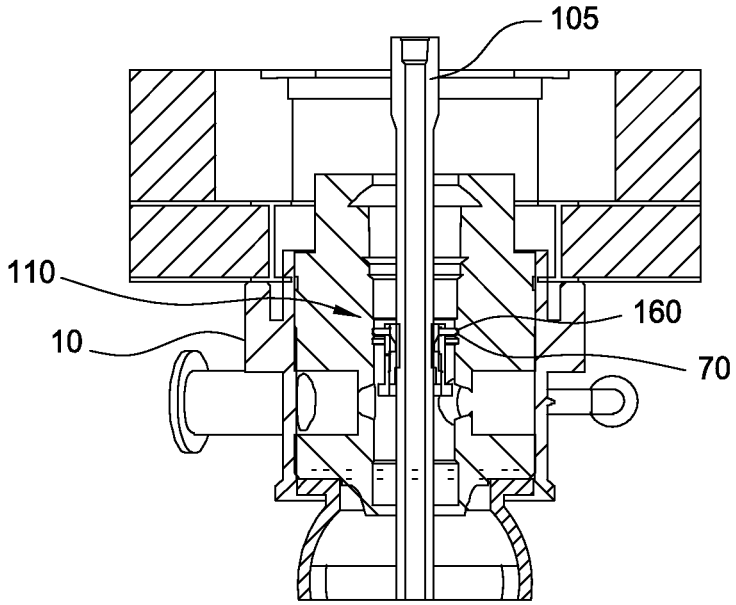
FIG. 11 is a view illustrating the upper portion of the compensator system engaged in a diverter housing.

FIG. 11 is a view illustrating an upper portion of the compensator system 100 engaged in the diverter housing 10. In one of the last steps in the rig up tool sequence, the mandrel 105 moves within the diverter housing 10 until the diverter lock 110 is positioned proximate profiles 70 within the diverter housing 10. Thereafter, dogs 160 in the diverter lock 110 are extended radially into engagement with the profiles 70. At this point, the upper portion of the compensator system 100 is fixed to the floating rig 5 via the diverter housing 10. In another embodiment, the upper portion of the compensator system 100 is secured directly to the floating rig 5 via a lock arrangement (not shown). In a further embodiment, the upper portion of the compensator system 100 is secured to a rotary table (not shown) attached to the floating rig 5. In any case, the upper portion of the compensator system 100 is attached (directly or indirectly) to the floating rig 5. Additionally, the locking of the compensator system 100 into the diverter housing 10 provides a stationary stump with respect to the rig floor 5 which may be used to perform surface operations.

In another embodiment, a packer (not shown) may be used in the diverter lock 110. In this embodiment, the packer is activated after the compensator system 100 is positioned within the diverter housing 10. Typically, pressurized fluid is used to activate the packer. Upon activation of the packer, the upper portion of the compensator system 100 is fixed to the diverter housing 10.

Figure 12B:
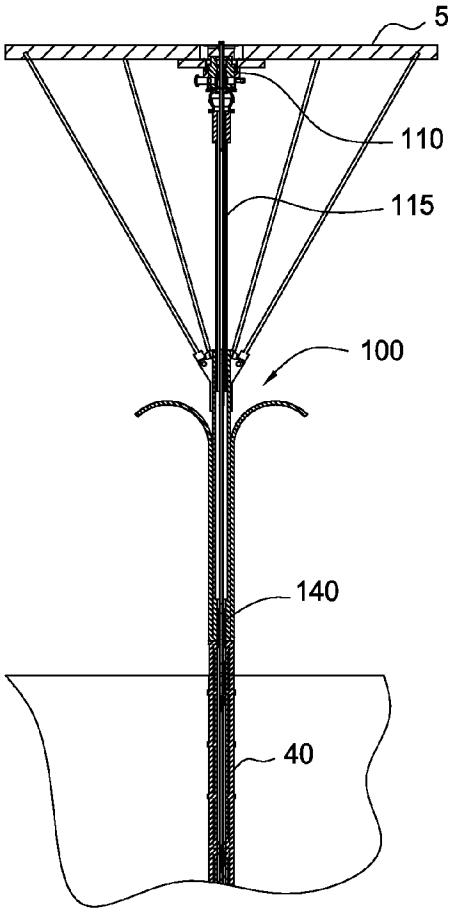
FIGS. 12A and 12B are views of the compensator system.
Figure 12A:
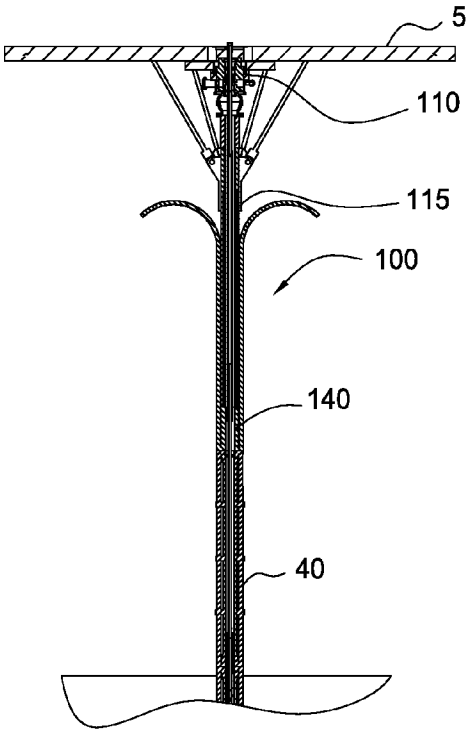

FIGS. 12A and 12B are views of the compensator system 100. In operation, the compensator system 100 may be used to compensate for the movement of the floating rig 5. After the upper portion of the compensator system 100 is fixed to the rig via the diverter lock 110 (see FIG. 11) and the lower portion of the compensator system 100 is fixed to the riser 40 via the locking assembly 140 (see FIG. 9), the compensator system 100 may compensate for the movement of the floating rig 5. Specifically, with the upper and lower portions of the compensator system 100 connected to the respective parts, the slip joint 115 in the compensator system 100 allows the compensator system 100 to compensate for the movement of the floating rig 5. The slip joint 115 is configured to accommodate tubing movement while maintaining a hydraulic seal between the upper and lower portions of the compensator system 100. In other words, the slip joint 115 is a telescoping joint disposed inline between the upper and lower portions of the compensator system 100 that permits the upper portion to move with the floating rig 5 while allowing the lower portion to be fixed relative to the wellhead at the seafloor. As the floating rig 5 moves relative to the seafloor, the slip joint 115 telescopes in as shown in FIG. 12A or out as shown in FIG. 12B by substantially the same amount so that the lower portion of the compensator system 100 below the slip joint 115 is relatively unaffected by the floating rig 5 motion.

Figure 13A:
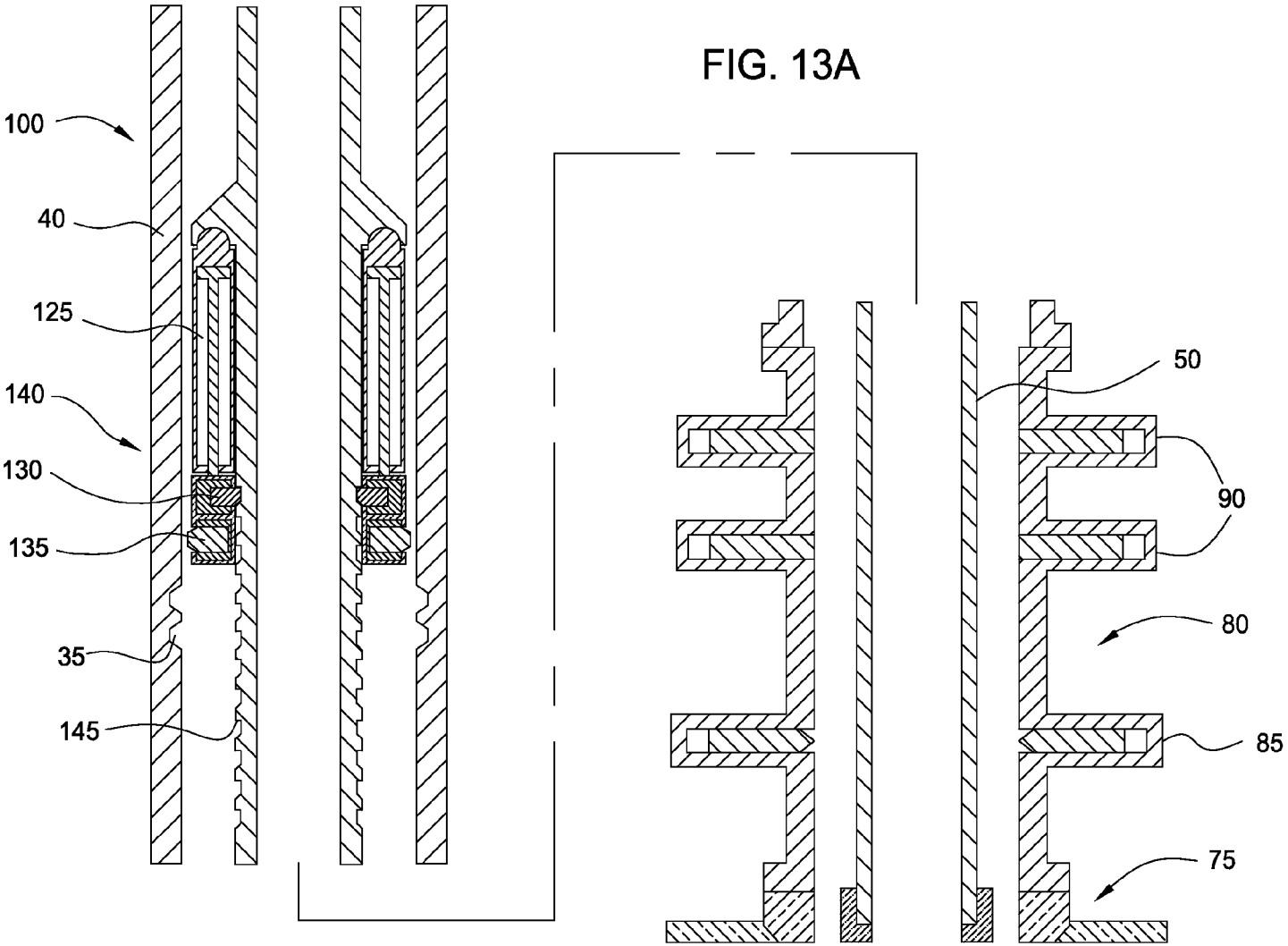
FIGS. 13A-13D are views illustrating the movement of the landing string upon activation of a ram in a BOP stack.
Figure 13B:
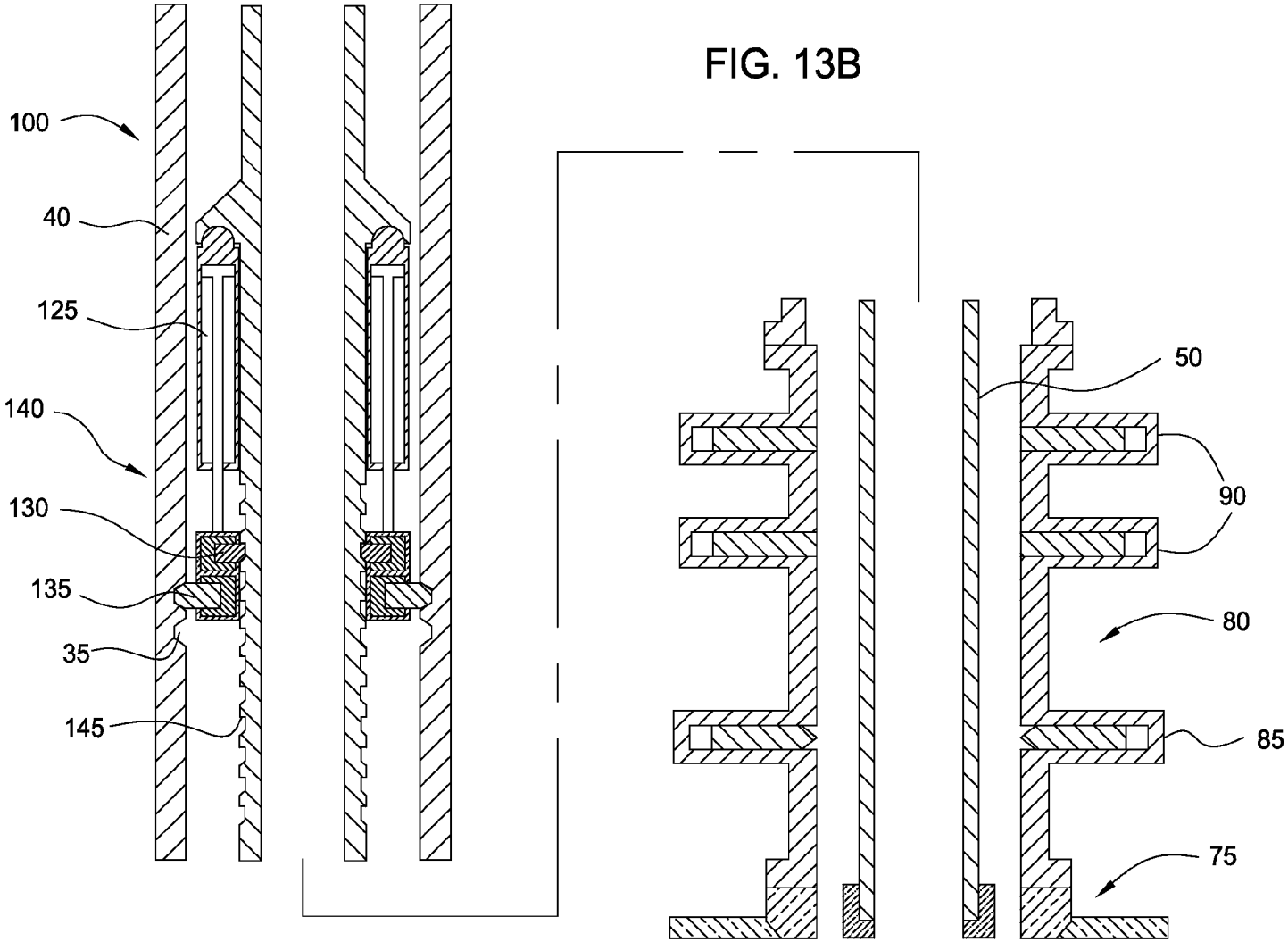

FIGS. 13A-13D are views illustrating the movement of the landing string 50 upon activation of shear rams 85 in a BOP stack 80. As previously set forth, the locking assembly 140 is activated by hydraulic pressure that is communicated to the cylinders 125, thereby causing the cylinders 125 to urge the dogs 135 along the locking mandrel 145 as the inner tabs 130 engage profiles on the locking mandrel 145. The dogs 135 continue to move along the locking mandrel 145 until the dogs 135 engage the profiles 35 in the riser 40. Applied pressure actuates both the tabs 130 and the dogs 135 via an internal bore of the rod in the cylinders 125. Once the dogs 135 locate the profiles 35 in the riser 40, as shown in FIG. 13B, pressure will immediately increase as the locking assembly 140 will not allow additional volume into the system. At this time, the cylinders 125 are locked, the dogs 135 are locked in the profiles 35 and the inner tabs 130 are locked in profiles on the locking mandrel 145. As also illustrated, a lower portion of the landing string 50 is positioned in the BOP 80 (Blow Out Preventer) that is attached to a wellhead 75.

Figure 13C:
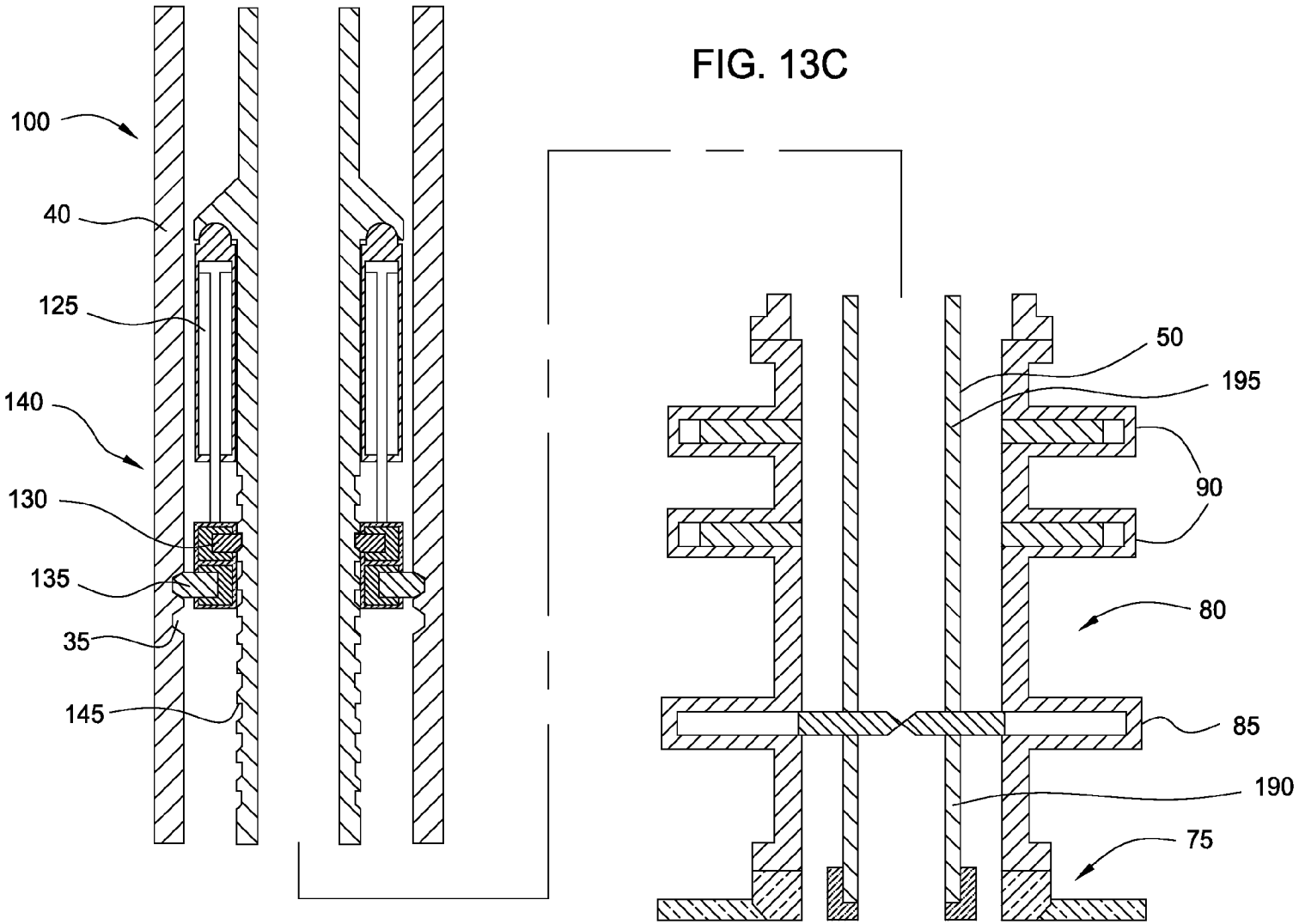
Figure 13D:
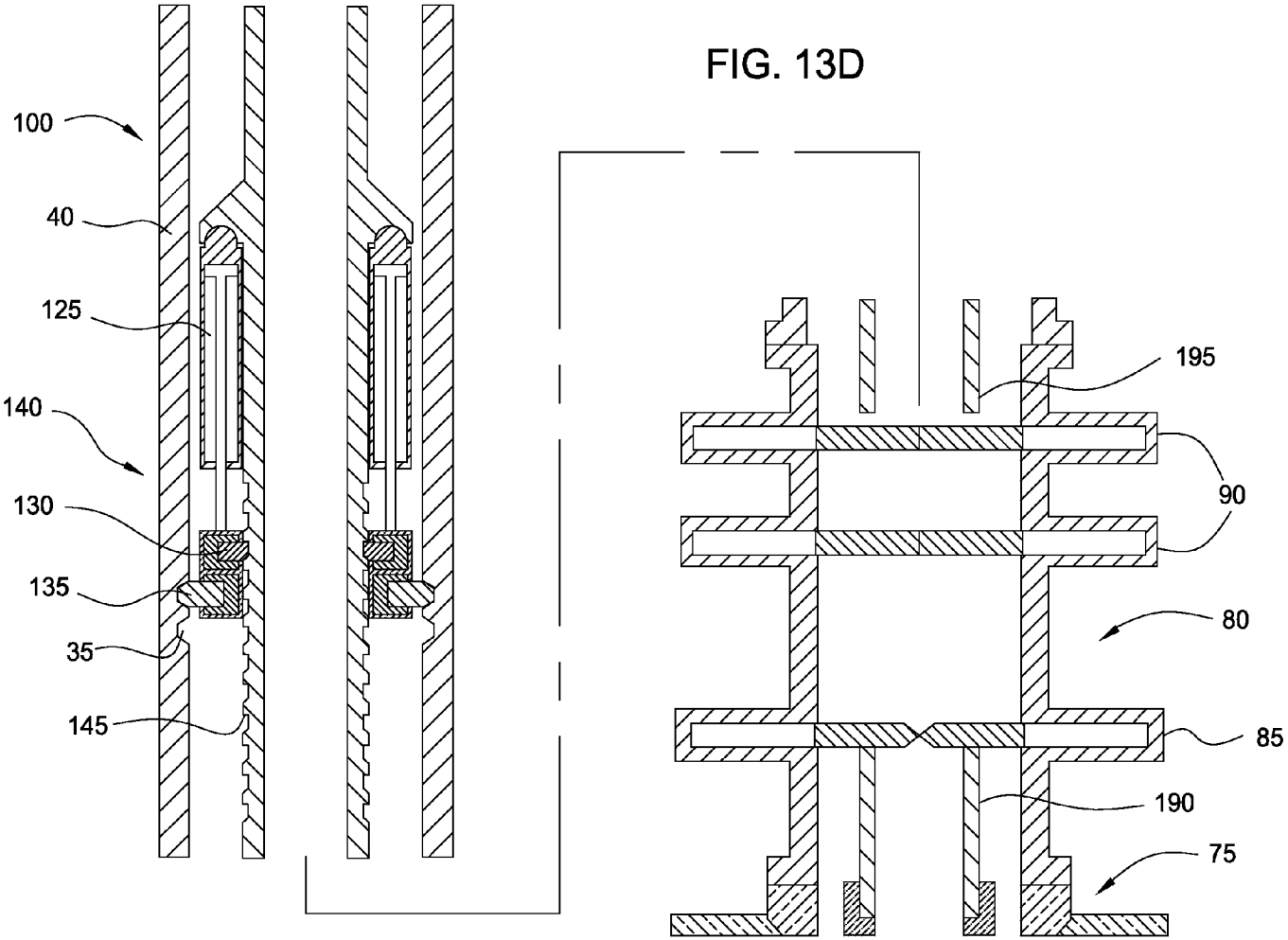

FIG. 13C illustrates the activation of the shear rams 85 in the BOP 80. If a safety-critical situation arises (e.g. in which the pressure in the wellbore has to be contained at short notice), the shear rams 85 are activated to cut the landing string 50 such that a first portion 190 of landing string 50 is separated from a second portion 195. Thereafter, the second portion 195 of the landing string 50 is moved relative to the BOP 80 in order to provide space to close blind rams 90 as shown in FIG. 13D. It is to be noted that prior to the activation of the shear rams 85, the landing string 50 below the locking assembly 140 may be in tension due to the pre-charging of the cylinders 125 as described herein. The tension in the landing string 50 enables the movement of the second portion 195 to be automatic upon separating from the first portion 190. The actuation of the BOP 80 in the safety-critical situation may be accomplished according to a pre-programmed time sequence. A sensor (not shown) may be used to detect that the second portion 195 has moved clear of the blind rams 90 and then signal that the blind rams 90 may close. The sensor data may be incorporated into the control logic for this sequence of operations.

In one embodiment, the movement of the second portion 195 of the landing string 50 relative to the BOP 80 is accomplished by utilizing the cylinders 125. As shown in FIG. 13D, an end of each cylinder 125 is connected to the second portion 195 of the landing string 50 and another end of each cylinder 125 is connected to the riser 40 via the locking assembly 140. Upon severing the landing string 50, the pistons in the cylinders 125 extend and lift the second portion 195 of the landing string 50 relative to the riser 40 by acting on the connection point (i.e. locking assembly 140) to the riser 40. The cylinders 125 may be energized as a step in the sequence and/or may be pre-charged to a required pressure as described herein. This movement also lifts the second portion 195 of the landing string 50 relative to the BOP 80 to allow the rams 90 to close. In one embodiment, the cylinders 125 are energized by pumping hydraulic fluid into the cylinders 125. In another embodiment, a subset of the cylinders 125 are precharged with nitrogen resting against a piston type "stop" at the bottom of these cylinders. Thereafter, the lower part of the cylinders is pressurized with hydraulic fluid that is plumbed to these pre-charged cylinders to support the landing string 50. In this embodiment, the volumes and pre-charge pressures are calculated so that the pre-charge cylinders are compressed about half-way when the landing string 50 is fully supported with the pressurized hydraulic fluid. In this arrangement, there is still enough nitrogen volume and energy in the pre-charged cylinders to lift the landing string the required distance, even though the system is energized with hydraulic fluid.

Similar to the rig up tool sequence of the compensator system 100 as set forth in FIGS. 4-11, the rig down tool sequence is performed to remove the compensator system 100 from the riser 40. In the rig down tool sequence, the dogs 160 in the diverter lock 110 are released from the diverter housing 10. Thereafter, a portion of the compensator system 100 is attached to the support structure to allow the support structure to support the weight of the compensator system 100 and the landing string 50. Next, the nitrogen pressure of the cylinders connected to the tensioner cables 25 is decreased. Subsequently, the dogs 135 of the locking assembly 140 are released from the profiles on the riser 40. The landing string is then released from the wellhead. Thereafter, the compensator system 100 is removed from the riser 40.

In another embodiment, the compensator system may be positioned in the riser such that upper portion of the compensator system is fixed to the rig via diverter lock and the lower portion is fixed relative to the wellhead at the seafloor by positioning a tubing hanger on the landing string in the wellhead. In this embodiment, the locking assembly 140 is not necessary. Further, in this embodiment, centralizers may be attached to the landing string in order to prevent the landing string from buckling in the riser. Similar to the other embodiments, the slip joint disposed between the upper and lower portions of the compensator system allows the upper portion to move with the rig while allowing the lower portion to be fixed relative to the wellhead at the seafloor.

Figure 14:
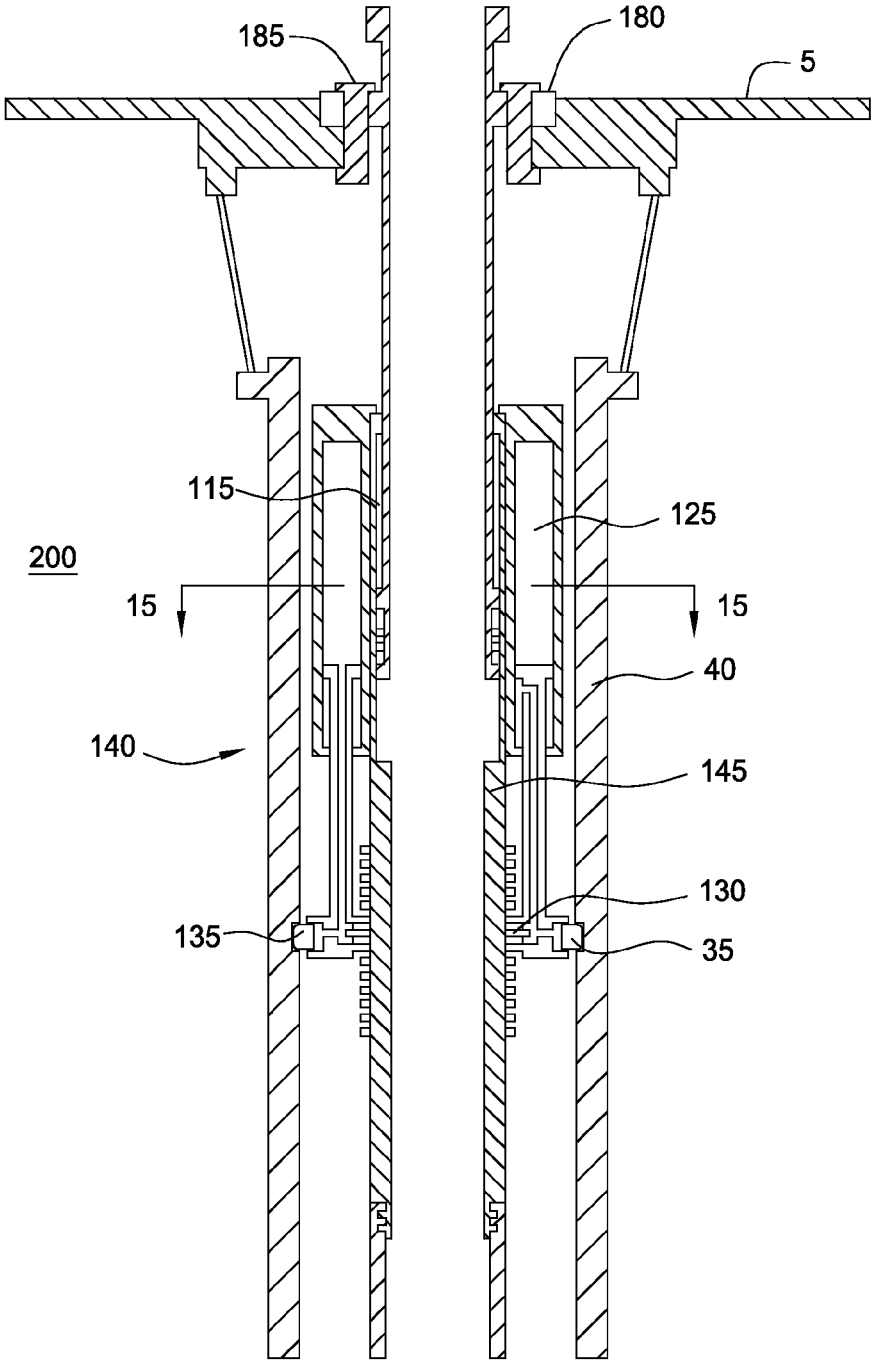
FIG. 14 is a view illustrating a landing string compensator system disposed in a riser.

FIG. 14 is a view illustrating a landing string compensator system 200 disposed in the riser 40. For convenience, the components in FIG. 14 that are similar to the components in FIGS. 1-12 will be labeled with the same reference indicator. The landing string compensator system 200 generally functions in a similar manner as the landing string compensator system 100.

Prior to landing out the tubing hanger, the compensator system 200 is picked up in the fully telescoped position and made up to the landing string 50. The compensator system 200 is locked to prevent movement between the upper and lower barrel of the slip joint 115. At this point, the compensator system 200 is totally passive and does not interfere and/or complicate the critical landing and locking of the tubing hanger, and compensation of the required set down weight is maintained in the conventional manner on the hook by a CMC or AHD system.

Figure 16:
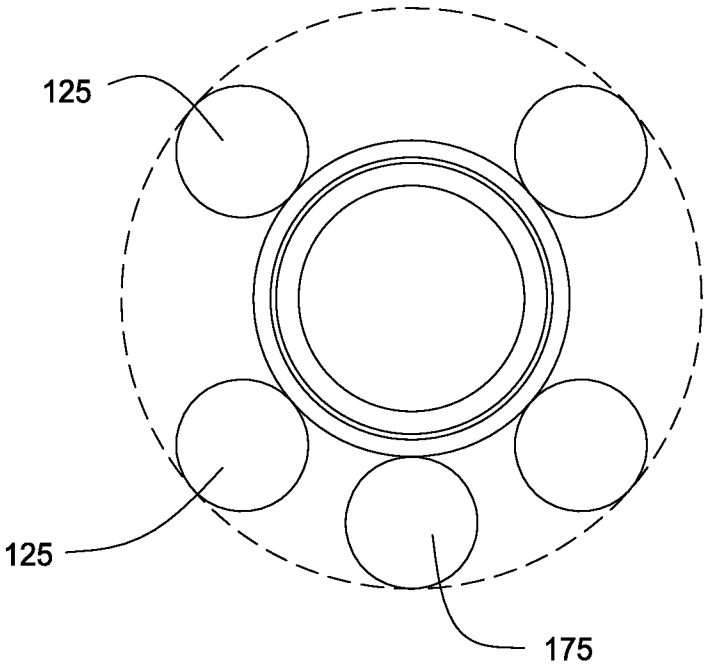
FIG. 16 is a view illustrating cylinders in the landing string compensation system.
Figure 15:
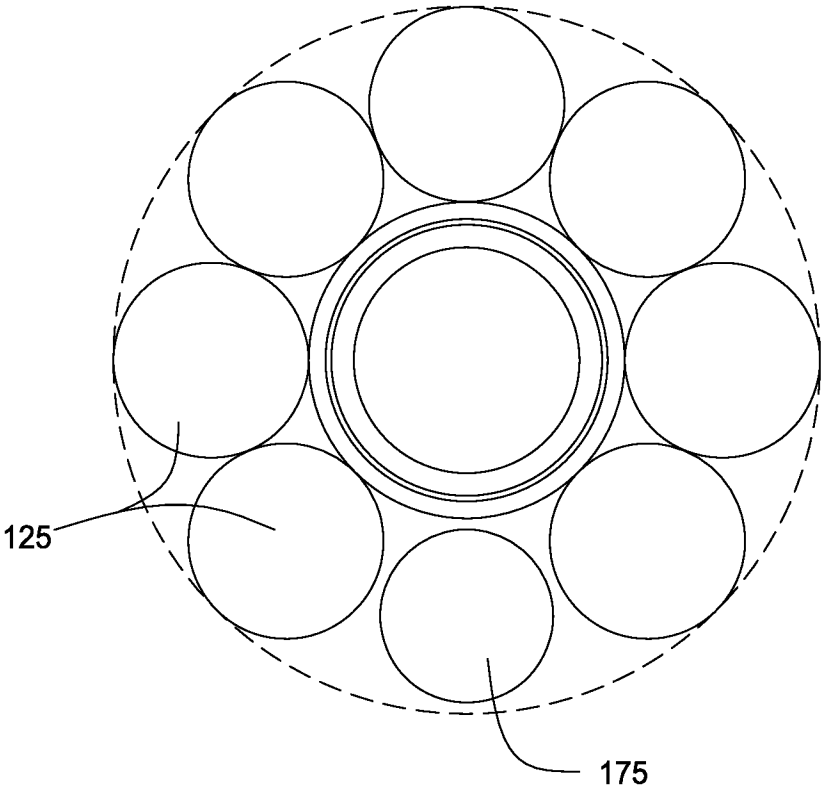
FIG. 15 is a view illustrating cylinders in the landing string compensation system.

FIG. 15 is a view illustrating the cylinders 125 in the compensator system 200. As shown in FIG. 15, the cylinders 125 are spaced such that an umbilical 175 may be positioned adjacent the cylinders 125. In this arrangement, the compensator system 200 allows unobstructed pass through of the required umbilical 175 to perform the necessary landing and locking operations. It is to be noted that there may any number of cylinders and umbilical members without departing from the aspects of the present invention. For instance, there may be a smaller amount of cylinders 125 and the umbilical 175, as shown in FIG. 16.

Referring back to FIG. 14, after successful landing and locking the hanger, the compensator system 200 is unlocked and the cylinders 125 on the compensator system 200 are activated by applied pressure from an independent umbilical (not shown). Upon activation, the cylinders 125 extend and thereby moving the locking dogs 135 across the adjustable locking system 140, which consists of a plurality of locking profiles on the locking mandrel 145 that straddle a landing profile 35 located in the riser 40 a short distance below the rig floor 5. Typically, all floating drilling vessels have such a profile in their drilling riser to facilitate the use of a BOP Landing Assist Tool (BLAT). The locking and unlocking mechanisms between the inner and outer barrel of the tool may be any type mechanism known in the art, such as a hydraulic mechanism or an electrical mechanism.

As the applied pressure moves the actuating cylinders 125 down the adjustable locking system 140, the internal lock can move freely downward as the plurality of locking profiles on the locking mandrel 145 are biased to allow downward movement via an upper taper on each ring (typical ratchet mechanism). Additionally, the applied pressure actuates both the internal and external locking dogs 130, 135 via an internal bore of the rod in a subset of the cylinders 125. Once the external locking dogs 135 locate the interior profile 35 in the drilling riser 40, pressure will immediately increase, as the locking mechanism 140 will not allow additional volume into the system, indicating successful locking of the compensator system 200 to the drilling riser 40. This pressure will be maintained continuously during the operation; however, if pressure is inadvertently lost, the compensator system 200 will remain locked to the riser 40 via a locking spring system (not shown). It is to be noted that the locking spring system may be any type of locking and locking spring mechanism known in the art without departing from principles of the present invention.

At this point in time, the riser compensator and the CMC/AHD hook compensator are working in unison to compensate for the heave of the rig 5 for the riser 40 and landing string 50. The operator then "airs down" the CMC or reduces the compensated weight on the AHD. This will slack off the landing string 50, collapsing the slip joint 115 until lock down bushings enter 180 the rotary table on the rig 5, and at that time they are locked into the rotary table via locks 185. This will allow high pressures to be introduced into the landing string 50 and the compensator system 200, with the resultant up thrust load being restrained by the lock down bushings 180.

At this point, as the rig 5 heaves, the riser compensator arrangement will also compensate the landing string 50 by virtue of the locking system on the compensator system 200. The inner and outer barrel of the slip joint 115 allows free, compensated movement of the landing string 50 without any movement above the rig 5. Therefore, the operator is free at this time to rig up pressure containment equipment at a static, low height, similar to a stable jack up or land drilling rig. To monitor the effectiveness of the compensation, a strain gauge may be mounted on the exterior of the lower barrel of the compensator system 200 to monitor the landing string 50 tension which should remain fairly constant. This power and transmission of this data is accomplished through the independent umbilical.

It should be mentioned that if additional pressure is added to the hydraulic cylinders 125, additional compensation can be achieved in the event the response of the riser tensioners in the riser compensator arrangement is found to be inadequate, thereby achieving a shared compensation system. In other words, compensation of the landing string 50 can be achieved either by the riser tensioners in the riser compensator arrangement or applied pressure to the cylinders 125 or a combination thereof. Further, in another embodiment, by modifying the compensation system 200 to eliminate the external locking dog 135 that locks the compensation system 200 to the riser 40, a fully independent compensation system can be achieved. In this embodiment, a constant supply of pressure under varying volumetric requirements would be required.

At the end of the operation, a complete reverse of the above procedure is performed to unlock the compensation system 200. One difference in the unlocking operation is the retracting of the hydraulic cylinders 125 that is accomplished by pressuring up on the rod side of the cylinders 125 to provide an upward movement. Additionally a subset of the hydraulic cylinders 125 have an internal bore that is plumbed to the opening side of the internal and external locking dogs 130, 135 that lock and/or unlock the compensation system 200 to the profile 35 in the riser 40, thereby releasing the compensation system 200 from the riser 40. These types of unlocking mechanism designs are well known and used in the industry and will not be covered in detail here.

Figure 17:
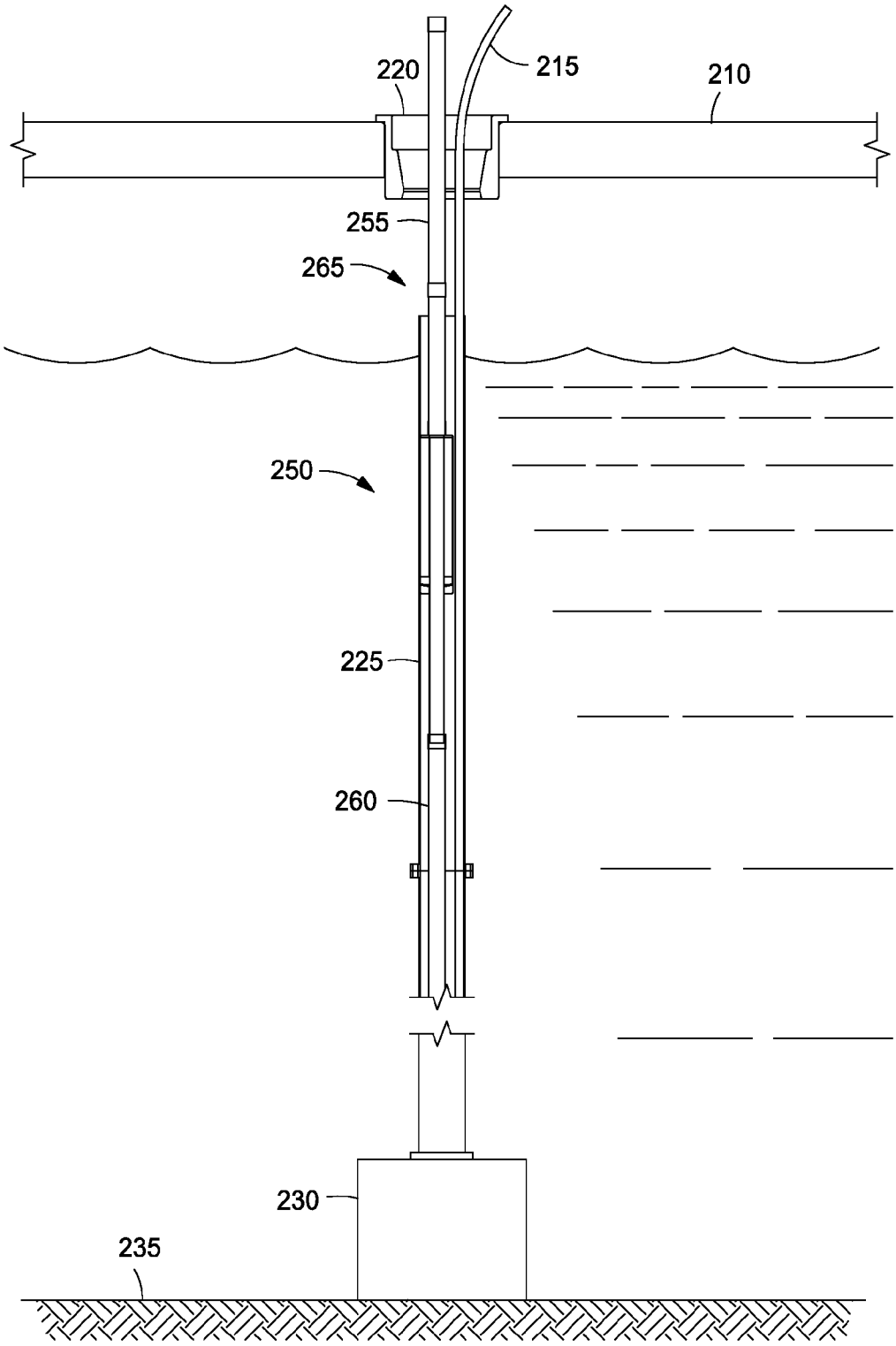
FIG. 17 is a view of a compensator system for a landing string according to one embodiment of the invention.

FIG. 17 is a view of a compensator assembly 250 for use with a landing string according to one embodiment of the invention. Generally, the compensator assembly 250 is used to compensate for the movement of a floating rig platform 210 relative to an ocean floor 235. As illustrated, the floating rig platform 210 is connected to a wellhead 230 disposed on the ocean floor 235 via a riser 225. As also illustrated, a control line 215 is disposed in the riser 235. The control line 215 may be used to send control signals to various tools in a wellbore (not shown).

A landing string assembly 265 is disposed in the riser 225. The landing string assembly 265 includes a first landing string joint 255 and a second landing string joint 260. A lower end of the first landing string joint 255 is connected to an upper end of the second landing string via the compensator 250. Further, an upper end of the first landing string joint 255 is connected to the floating rig platform 210 via a spider 220. Generally, the spider 220 is used to support the landing string joint 255 by employing a slip arrangement that grips an outside surface of the landing string joint 255. Additionally, a lower end of the second landing string joint 260 is fixed relative to the wellhead 230 disposed on the ocean floor 235.

Figure 18:
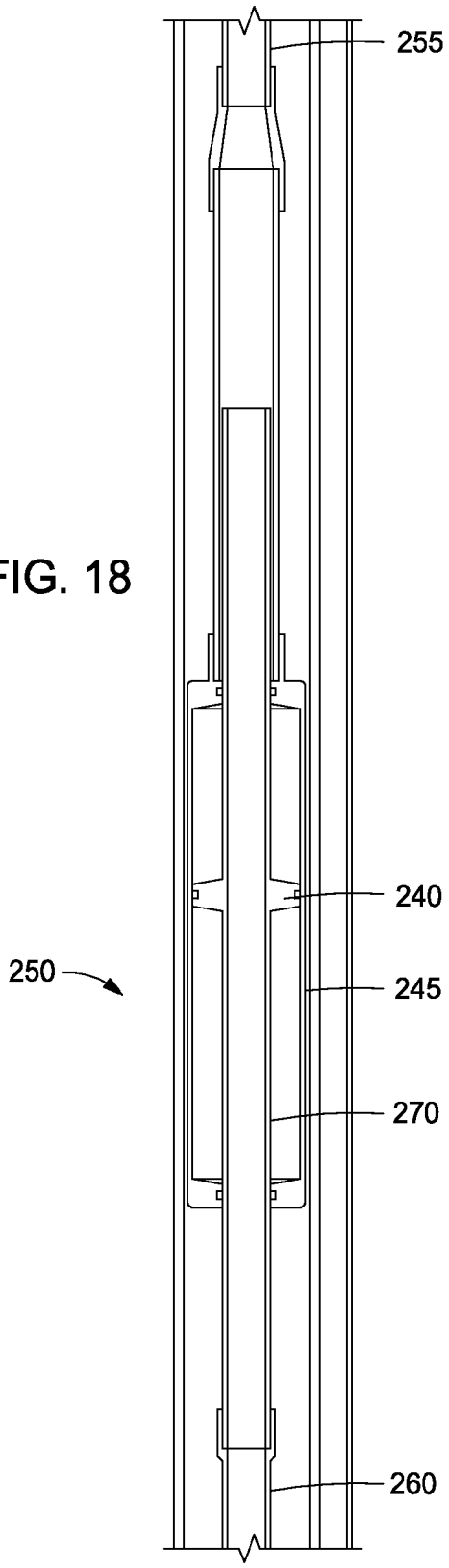
FIGS. 18 and 19 are enlarged views of the compensator system of FIG. 17.
Figure 19:
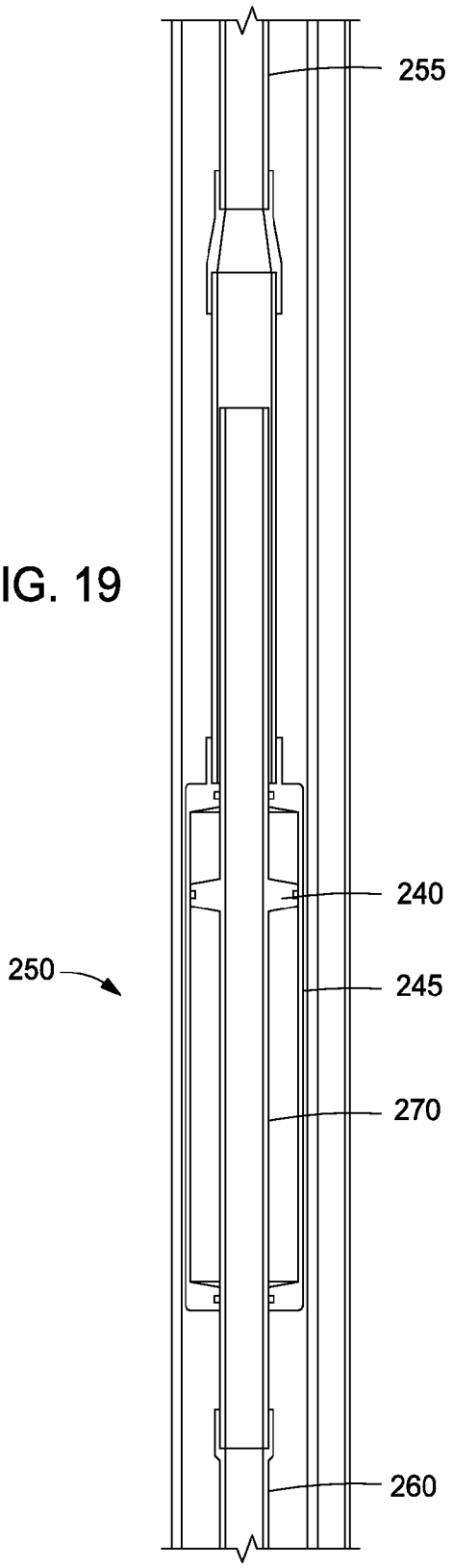

As shown in FIG. 18, the compensator assembly 250 includes a housing 245 and a piston bearing 240 movably disposed in the housing 245. The piston bearing 240 includes a piston rod 270 that is connected to the second landing string joint 260 and the housing 245 is connected to the first landing string joint 255. As the floating rig platform 210 moves relative to the ocean floor 235, the piston bearing 240 and the piston rod 270 moves within the housing 245 as shown in FIG. 19. In other words, the movement of the piston bearing 240 and the piston rod 270 which are connected to the second landing string joint 260 allows the second landing string joint 260 to move relative to the first landing string joint 255 which is connected to the housing 265, thereby compensating for the movement of the floating rig platform 210. In this manner, as the floating rig platform 210 moves relative to the ocean floor 235, the piston rod 270 moves within the housing 245 by the same amount so that the second landing string joint 260 below the compensator assembly 250 is relatively unaffected by the floating rig platform 210 motion.

The piston bearing 240 and the piston rod 270 includes a bore that is in fluid communication with the bores in the landing joints 255, 260. This arrangement allows fluid to pass through the landing joints 255, 260 and the compensator assembly 250. Additionally, the piston bearing 240 and the housing 245 may be configured with a spline arrangement, whereby torque may transmitted through the joint 255 to the joint 260 via the compensator assembly 250. The compensator assembly 250 may also include wipers, rod bearing bands and rod seals. The compensator assembly 250 may also include a first control line (not shown) connected to housing 245 above the piston bearing 240 and/or a second control line (not shown) connected to the housing 245 below the piston bearing 240. The control lines may extend from the floating rig platform 210 to be used to selectively pressurize or depressurize either end of the piston bearing 240 to control the motion of the piston bearing 240 within the housing 245.

The compensator assembly 250 will adjust to compensate for the floating rig platform 210 movement, while allowing matter to continuously flow through and around the compensator assembly 250, because all sections are sealed off from each other to prevent interference and contamination. The compensator assembly 250 is controlled by either a manual system or an automated system or some combination of each. The compensator assembly 250 may also allow for rotation and for the transmission of torque to items further down the assembly. This may be accomplished by splines/keys cut into the outer diameter of each rod, located before the piston bearing 240 with respect to the center of the compensator assembly 250.

Figure 20:
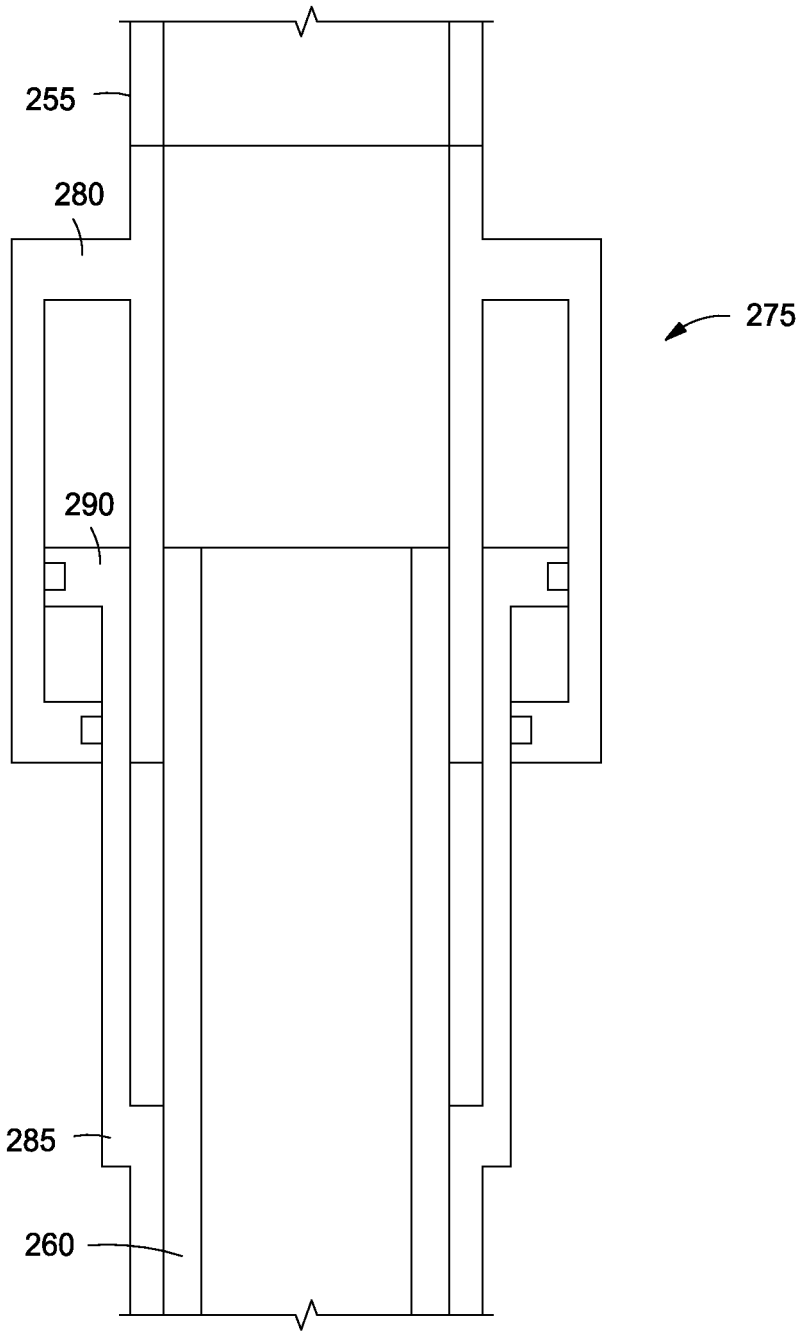
FIG. 20 is a view of a compensator system for a landing string according to one embodiment of the invention.

In another embodiment as shown in FIG. 20, a compensator assembly 275 may be used to compensate for the movement of the floating rig platform 210 relative to the ocean floor 235. The compensator assembly 275 functions in essentially the same manner as the compensator assembly 250. An upper portion 280 of the compensator assembly 275 is attached to the first landing joint 255 and a lower portion 285 of the compensator assembly 275 is attached to second landing joint 260. Further, the compensator assembly 250 may also include a first control line (not shown) connected to the upper portion 280 above a piston member 290 and/or a second control line (not shown) connected to the lower portion 285 below the piston member 290. The control lines may extend from the floating rig platform 210 to be used to selectively pressurize or depressurize either end of the piston member 290 to control the motion of the member 290 within the portions 280, 285.

Figure 21:
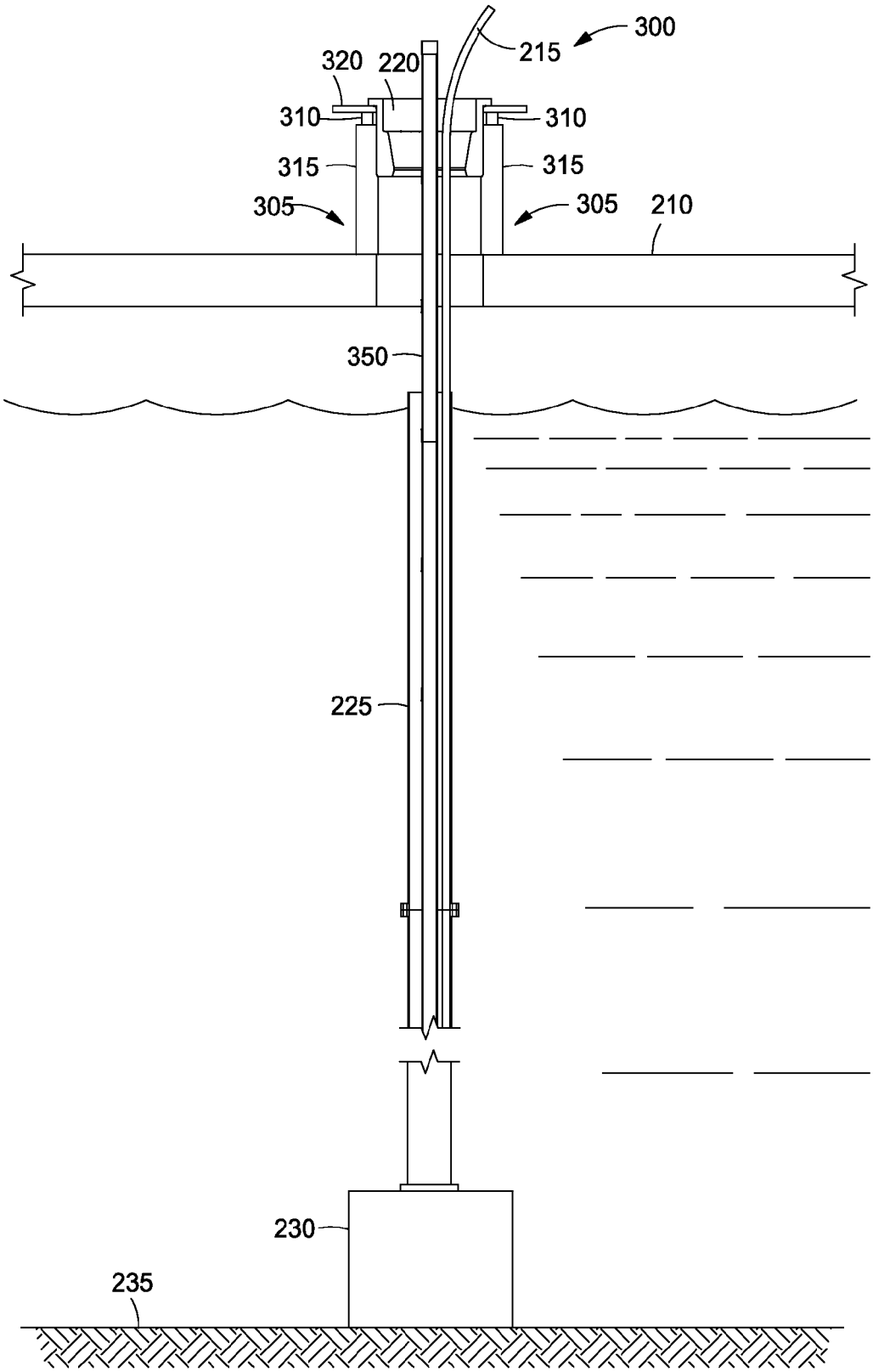
FIG. 21 is a view of a compensator system for a landing string according to one embodiment of the invention.

FIG. 21 is a view of a compensator assembly 300 for use with a landing string 350 according to one embodiment of the invention. For convenience, the components in FIG. 21 that are similar to the components in FIG. 17 will be labeled with the same reference indicator. The compensator assembly 300 is used to compensate for the movement of the floating rig platform 210 relative to the ocean floor 235. In other words, the compensator assembly 300 is configured to allow the landing string 350 to remain substantially stationary relative to the ocean floor 235.

The compensator assembly 300 comprises a plurality of cylinders 305 and a movable platform 320. The movable platform 320 essentially functions as a second rig platform. The movable platform 320 is configured to support (or hold) the spider 220, the slips or any other tools that normally would be supported from the floating rig platform 210. As illustrated, the movable platform 320 is connected to the floating rig platform 210 by a plurality of cylinders 305. It should be noted that even though the movable platform 320 is shown as sitting on top of the floating rig platform 210, the movable platform 320 could also be attached below or recessed within the floating rig platform 210 without departing from the principles of the present invention.

Figure 22:
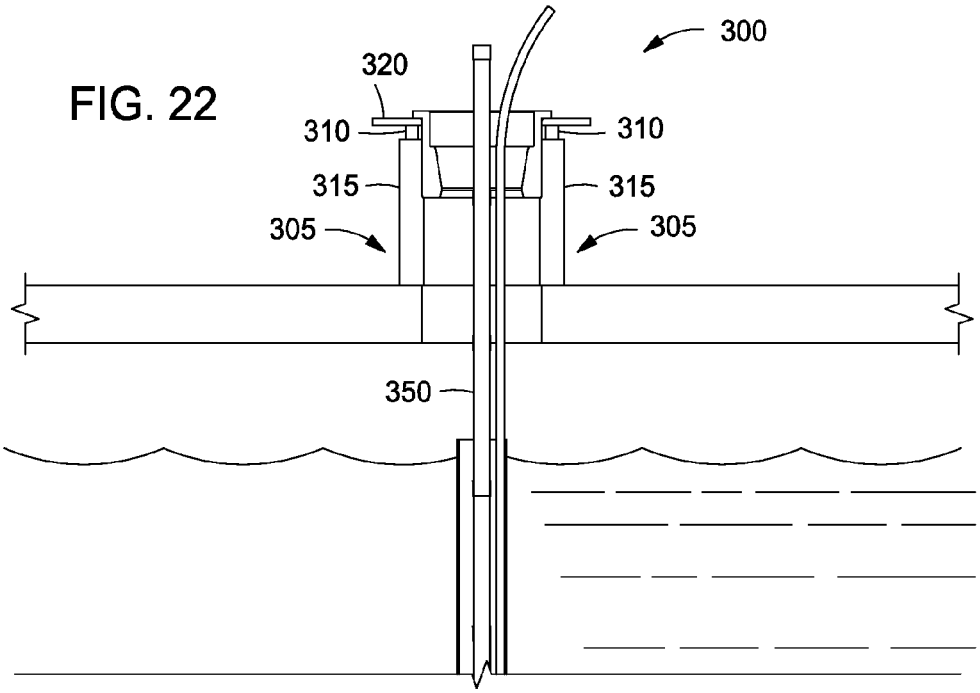
FIG. 22 is a view illustrating a cylinder member in the compensator system of FIG. 21 in a retracted position.
Figure 23:
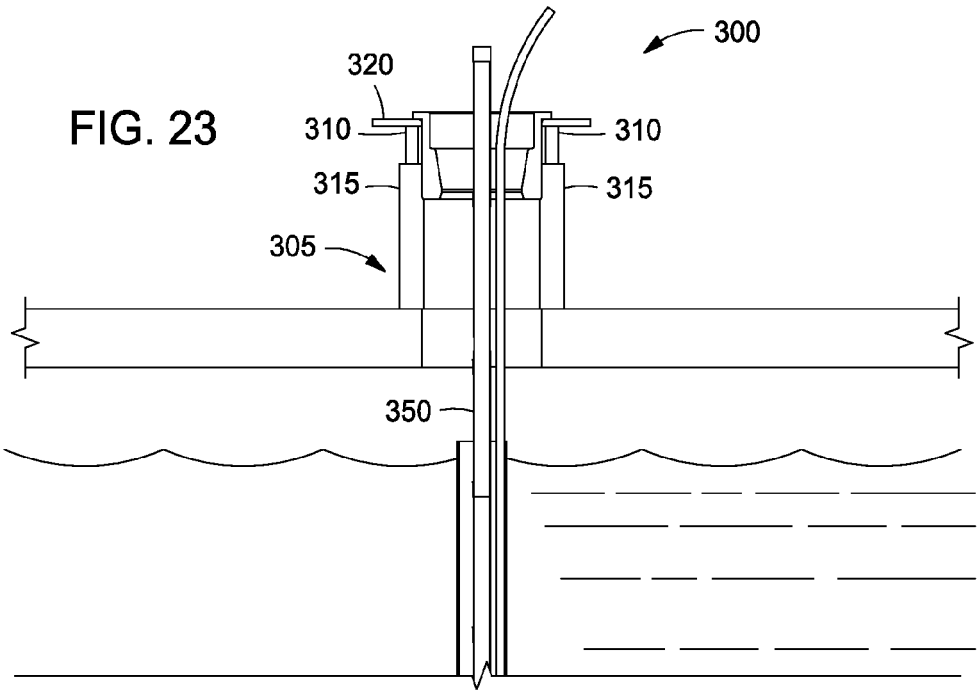
FIG. 23 is a view illustrating the cylinder member in the compensator system of FIG. 21 in an extended position.

Each cylinder 305 includes a rod 310 that is movable relative to a cylinder housing 315. Further, control lines (not shown) are connected to each cylinder 305 to control the movement of the rod 310 in the cylinder housing 315 by selectively pressurizing and depressurizing the cylinders. The cylinders 305 may be controlled a manual system, an automated system or combinations thereof. As illustrated in FIG. 22, the cylinder housing 315 is connected to the floating rig platform 210 and the rod 310 is connected to the movable platform 320. As the floating rig 210 moves relative to the ocean floor 235, the cylinders 305 are selectively pressurized or depressurized to move the movable platform 320 accordingly in order to keep the landing string 350 substantially stationary relative to the ocean floor 235 as shown in FIG. 23.

Figure 24:
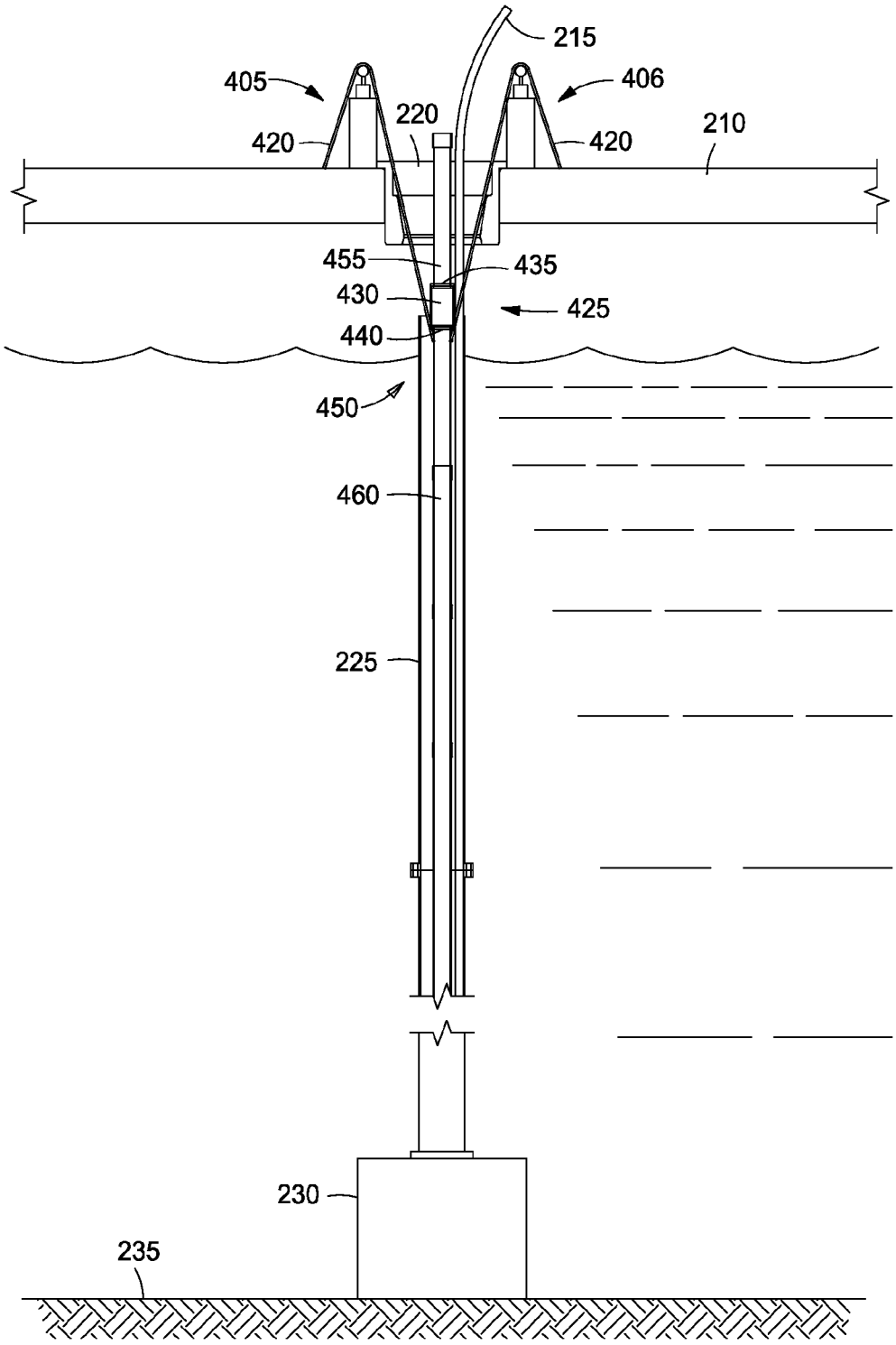
FIG. 24 is a view of a compensator system for a landing string according to one embodiment of the invention.

FIG. 24 is a view of a compensator assembly 400 for use with a landing string assembly 450 according to one embodiment of the invention. For convenience, the components in FIG. 24 that are similar to the components in FIG. 17 will be labeled with the same reference indicator. The compensator assembly 400 is used to allow a first portion of the landing string assembly 450 to move as the floating rig platform 210 moves relative to the ocean floor 235 while allowing a second portion of the landing string assembly 450 to remain substantially stationary relative to the ocean floor 235.

The compensator assembly 400 comprises a plurality of cylinders 405, a plurality of support cables 420 and a slip joint member 425. As shown in FIG. 24, the slip joint member 425 is connected to the cylinders 405 via the support cables 420. Generally, the slip joint member 425 is configured to accommodate tubing movement while maintaining a hydraulic seal between a first landing string joint 455 and a second landing string joint 460 in the landing string assembly 450. In other words, the slip joint member 425 is a telescoping joint disposed inline between the first landing string joint 455 and the second landing string joint 460 that permits the first landing joint 455 to move with the floating rig platform 210 while allowing the second landing string joint 460 to be fixed relative to the wellhead 230 at the ocean floor 235. As the floating rig platform 210 moves relative to the ocean floor 235, the slip joint member 425 telescopes in or out by substantially the same amount so that the second landing string joint 460 below the slip joint member 425 is relatively unaffected by the floating rig platform 210 motion.

The slip joint member 425 includes a housing 430, a first movable end 435 and a second movable end 440. The first moveable end 435 is connected to the first landing joint 455 and the second moveable end 440 is connected to the second landing joint 460. Each end 435, 440 includes seals that are configured to seal around the joints 455, 460 to prevent contamination from entering the slip joint member 425. As the floating rig platform 210 moves relative to the ocean floor 235, the first moveable end 435 attached to the first landing joint 455 and the second moveable end 440 attached to the second landing joint 460 move within the housing 430.

Figure 25:
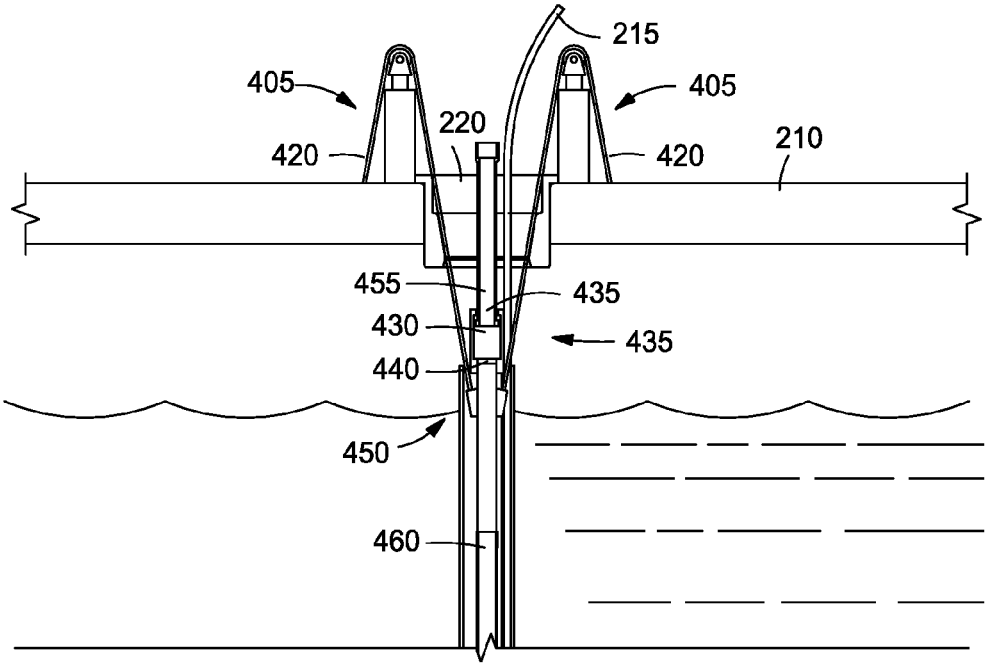
FIG. 25 is a view illustrating a cylinder member in the compensator system of FIG. 24 in a retracted position.
Figure 26:
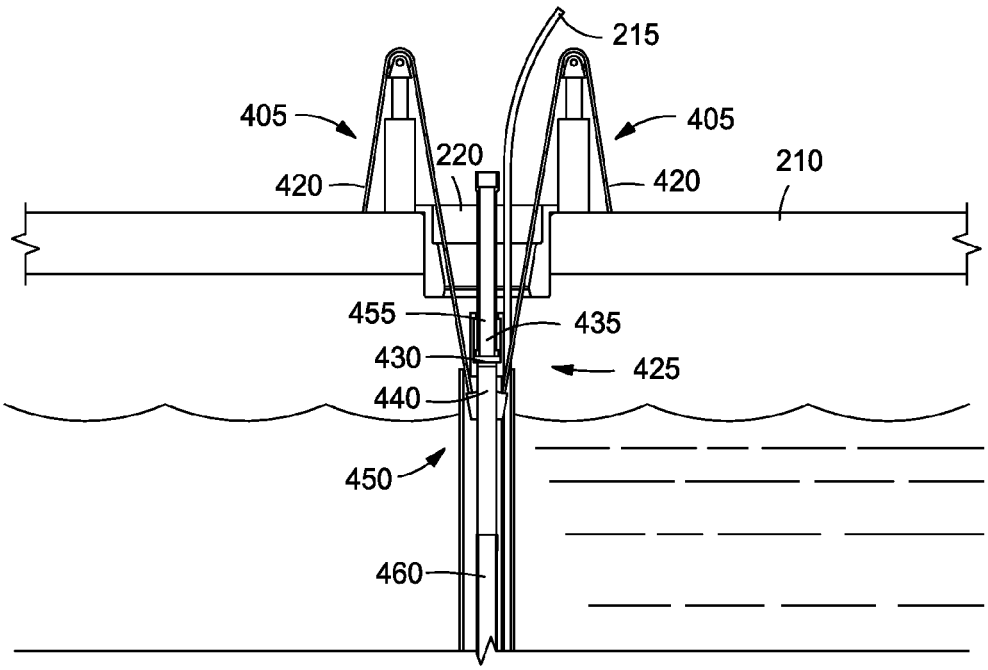
FIG. 26 is a view illustrating the cylinder member in the compensator system of FIG. 24 in an extended position.

As shown in FIG. 25, each cylinder 405 includes a rod 410 that is movable relative to a cylinder housing 415. Further, control lines (not shown) are connected to each cylinder 405 to control the movement of the rod 410 in the cylinder housing 415. The cylinders 405 may be controlled a manual system, an automated system or combinations thereof. As illustrated in FIG. 26, the cylinder housing 415 is connected to the floating rig platform 210 and the rod 410 is connected to the second landing joint 460 via the support cables 420. As the floating rig 210 moves relative to the ocean floor 235, the cylinders 405 are selectively pressurized or depressurized to move the support cables 420 and manage the weight of the second landing joint 460 accordingly in order to keep the second landing joint 460 substantially stationary relative to the ocean floor 235.

As illustrated in FIG. 24, the slip joint member 430 is disposed proximate an upper end of the landing string assembly 450. In another embodiment, the slip joint member 430 is disposed proximate a lower end of the landing string assembly 450. In this embodiment, the plurality of cylinders 405 and the plurality of cables 420 would not be necessary because the weight of the second landing joint 460 would be relatively minimal.

Figure 27:
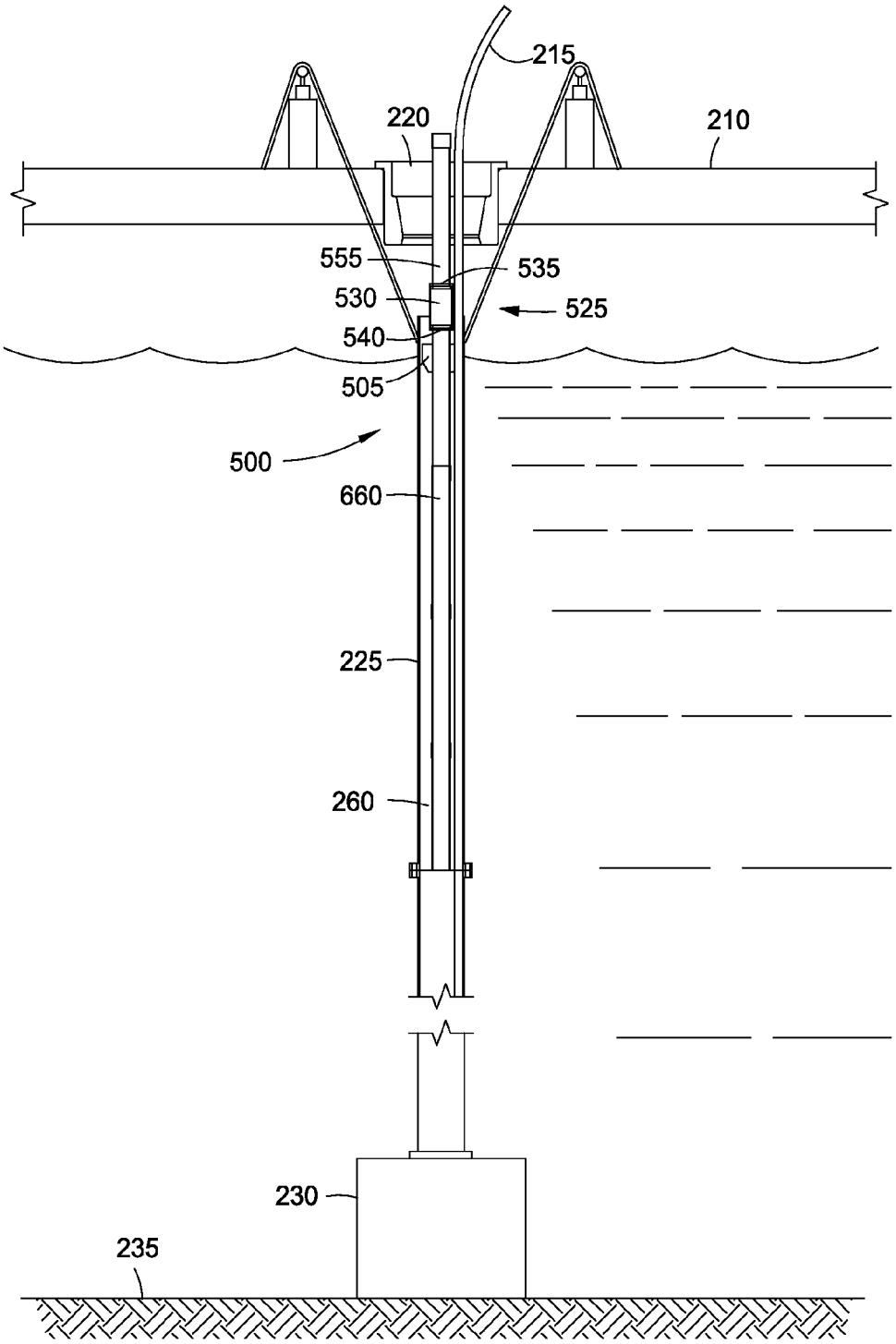
FIG. 27 is a view of a compensator system for a landing string according to one embodiment of the invention.

FIG. 27 is a view of a compensator assembly 500 for use with a landing string assembly 550 according to one embodiment of the invention. For convenience, the components in FIG. 27 that are similar to the components in FIG. 17 will be labeled with the same reference indicator. Similar to other embodiments, the compensator assembly 500 is used to allow a portion of the landing string assembly 550 to move as the floating rig platform 210 moves relative to the ocean floor 235.

The compensator assembly 500 comprises a clamp member 505 and a slip joint member 525. The slip joint member 525 is a telescoping joint disposed inline between a first landing string joint 555 and a second landing string joint 560 that permits floating rig platform 210 to move while allowing the second landing string joint 560 to be fixed relative to the wellhead 230 at the ocean floor 235. The slip joint member 525 includes a housing 530, a first movable end 535 and a second movable end 540. The first moveable end 535 is connected to the first landing joint 555 and the second moveable end 540 is connected to the second landing joint 560. Each end 535, 540 includes seals that are configured to seal around the joints 555, 560 to prevent contamination from entering the slip joint member 525. As the floating rig platform 210 moves relative to the ocean floor 235, the first moveable end 535 attached to the first landing joint 555 and the second moveable end 540 attached to the second landing joint 560 move within the housing 530 by substantially the same amount so that the second landing string joint 560 below the slip joint member 525 is relatively unaffected by the motion of the floating rig platform 210.

The clamp member 505 of the compensator assembly 500 is used to attach the second landing string joint 560 below the slip joint member 525 to the riser 225. The clamp member 505 may be any clamp member known in the art. For instance, the clamp member 505 may be a wedge type member, wherein the clamp member 505 wedges itself to an inside wall of the riser 225 as shown in FIG. 27. In another embodiment, the clamp member may be attachable to an outer surface of the riser 225 or to a top edge of one or joints. Additionally, the clamp member 505 may be repeatably attached to and released from the riser 225 during the landing operation. Further, the clamp member 505 may be attached when the landing string 550 is in position. The clamp member 505 may be autonomously actuated by relative movement between the floating rig platform 210 and the wellhead 230. Furthermore, the clamp member 505 may be actuated selectively from the floating rig platform 210 by control commands, signals, pressure, etc. In any case, the clamp member 505 is configured to attach the landing string assembly 550 to the riser 225 in order to utilize a riser compensation system attached to the riser 225. As known in the art, the riser compensation system is configured to maintain the riser 225 substantially stationary relative to the ocean floor 235 as the floating rig platform 210 moves relative to the ocean floor 235. The riser compensation system may be controlled by an operator or an autonomous/positional system.

After the clamp member 505 attaches the second landing string joint 560 to the riser 225, the second landing string joint 560 will move with the riser 225. In this manner, as the floating rig 210 moves relative to the ocean floor 235 the riser compensation system keeps the riser 225 and the second landing joint 560 substantially stationary relative to the ocean floor 235.

Figure 28:
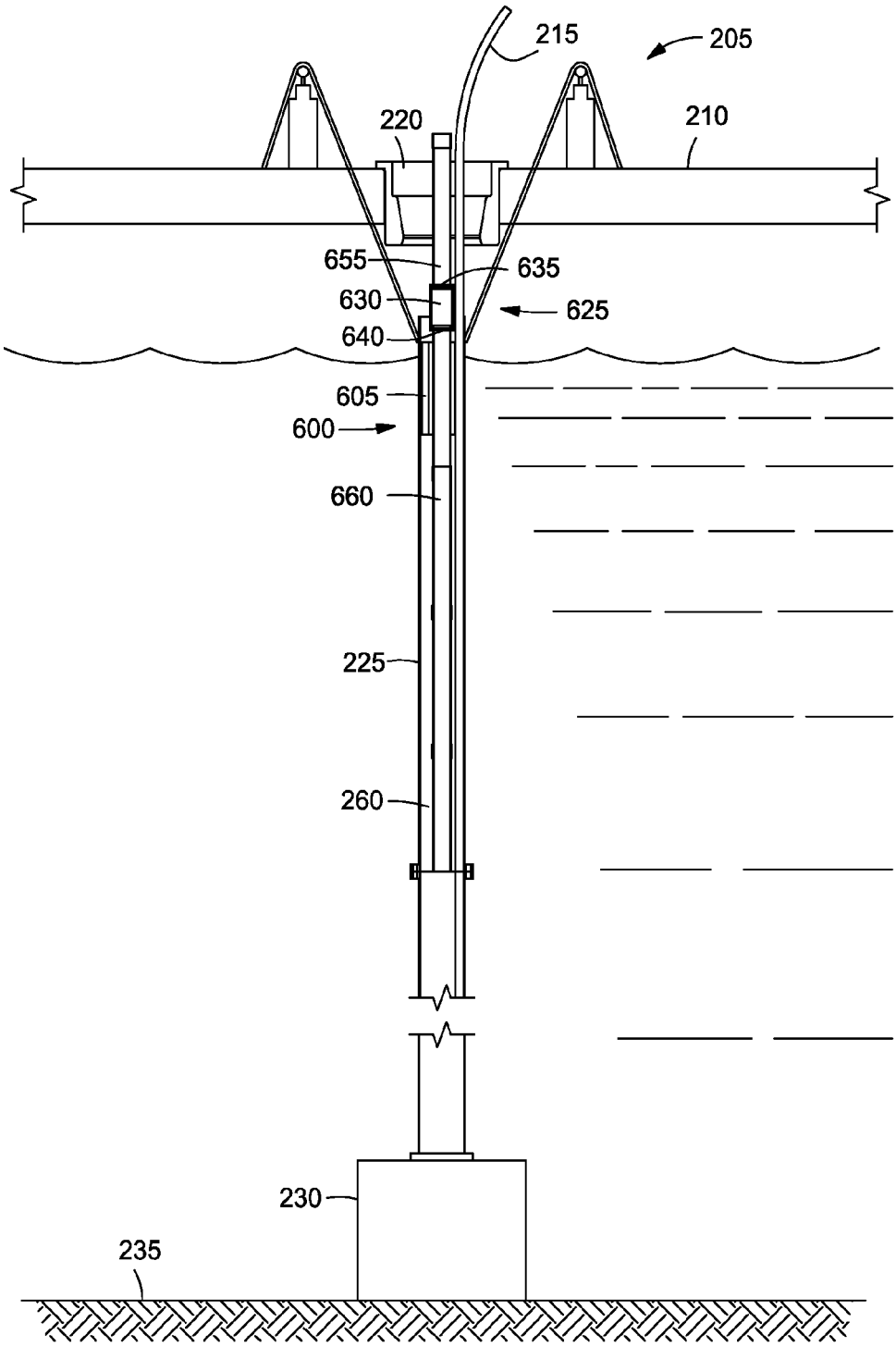
FIG. 28 is a view of a compensator system for a landing string according to one embodiment of the invention.

FIG. 28 is a view of a compensator assembly 600 for use with a landing string assembly 650 according to one embodiment of the invention. For convenience, the components in FIG. 28 that are similar to the components in FIG. 17 will be labeled with the same reference indicator. Similar to other embodiments, the compensator assembly 600 is used to allow a portion of the landing string assembly 650 to move while another portion of the landing string assembly 650 remains stationary as the floating rig platform 210 moves relative to the ocean floor 235.

The compensator assembly 600 comprises a flotation member 605 and a slip joint member 625. The slip joint member 625 is a telescoping joint disposed inline between a first landing string joint 655 and a second landing string joint 660 that permits the first landing string joint 655 to move with floating rig platform 210 while allowing the second landing string joint 660 to be fixed relative to the wellhead 230 at the ocean floor 235. The slip joint member 625 includes a housing 630, a first movable end 635 and a second movable end 640. The first moveable end 635 is connected to the first landing joint 655 and the second moveable end 640 is connected to the second landing joint 660. Each end 635, 640 includes seals that are configured to seal around the joints 655, 660 to prevent contamination from entering the slip joint member 625. As the floating rig platform 210 moves relative to the ocean floor 235, the first moveable end 635 attached to the first landing joint 655 and the second moveable end 640 attached to the second landing joint 660 move within the housing 630 by substantially the same amount so that the second landing string joint 660 below the slip joint member 625 is relatively unaffected by the motion of the floating rig platform 210.

The flotation member 605 in the compensator assembly 500 is configured to maintain the second landing joint 660 in an equilibrium state inside the riser 225. In other words, the flotation member 605 is configured to cause the second landing joint 660 to float in fluid or other material that is disposed in an annulus 670 defined between the second landing joint 660 and the riser 225, thereby causing the second landing joint 660 to remain substantially stationary relative to the riser 225. At the same time, the slip joint member 625 permits the first landing joint 655 to move with the floating rig platform 210 while allowing the second landing string joint 660 to be fixed relative to the wellhead 230 at the ocean floor 235. The flotation member 605 may be made from any type of buoyant material known in the art. For instance, the flotation member may be made from plastic or synthetic foam. The flotation member 605 may also be made from a canister that houses a gas or another buoyant material. In any case, the flotation member 605 is configured to maintain the position of the second landing joint 660 within the riser 225. Additionally, the flotation member 605 may include a plurality of holes to allow fluid to flow up the annulus 670 past the flotation member 605.

While the foregoing is directed to embodiments of the present invention, other and further embodiments of the invention may be devised without departing from the basic scope thereof, and the scope thereof is determined by the claims that follow.

The invention claimed is:

1. A system for use with a landing string disposed within a riser and coupled to a floating vessel, wherein the riser is located below a floating vessel and includes a telescopic joint, the system comprising:

a first tubular attached to the landing string, the first tubular having a portion that is fixable to the riser at a point below the telescopic joint, wherein the first tubular includes a piston rod and a piston bearing extending radially outward from the piston rod; and a second tubular having a portion that is fixable relative to the floating vessel, wherein the second tubular includes a housing that includes an interior bore that is coaxial with the second tubular, and wherein the piston bearing engages the interior bore of the housing, and wherein the first and second tubulars are movable relative to each other in a telescopic arrangement between an extended position and a retracted position such that the piston bearing moves along the interior bore of the housing as the floating vessel moves relative to the riser.

2. The system of claim 1, further comprising a locking assembly that fixes the portion of the first tubular to the riser.

3. The system of claim 2, wherein the locking assembly includes cylinders, dogs operable to engage profiles in an inner surface of the riser, and tabs operable to engage profiles in an exterior surface of a locking mandrel.

4. The system of claim 1, further comprising a sensor that senses pressure in the landing string, wherein the sensed pressure data is used in the operation of a lubricator valve in the landing string.

5. A method for compensating a landing string disposed within a riser, wherein the riser is located below a floating vessel and includes a telescopic joint, the method comprising:

fixing a portion of a first tubular to the riser below the telescopic joint, wherein the first tubular includes a piston rod and a piston bearing extending radially outward from the piston rod;

fixing a second tubular relative to the floating vessel, wherein the second tubular includes a housing that includes an interior bore that is coaxial with the second tubular, and wherein the piston bearing engages the interior bore of the housing; and allowing the first and second tubulars to move relative to each other in a telescopic arrangement between an extended position and a retracted position such that the piston bearing moves along the interior bore of the housing as the floating vessel moves relative to the riser.

6. The method of claim 5, wherein the landing string is positioned within a BOP stack.

7. The method of claim 5, further comprising selectively changing a pressure in an interior volume of the housing on one side of the piston bearing relative to a volume in the housing on a second side of the piston bearing to urge movement of the piston bearing along the interior bore of the housing.

* * * * *